US006540652B1

(12) United States Patent
Ratzel et al.

(10) Patent No.: US 6,540,652 B1
(45) Date of Patent: Apr. 1, 2003

(54) CUSHIONING CONVERSION MACHINE AND METHOD

(75) Inventors: Richard O. Ratzel, Westlake, OH (US); Roger P. M. Rinkens, Brunssum (NL); Michael J. Lencoski, Claridon Township, OH (US); Dirk J. Siekmann, Telford (GB)

(73) Assignee: Ranpak Corp., Concord Township, OH (US)

( * ) Notice: Subject to any disclaimer, the term of this patent is extended or adjusted under 35 U.S.C. 154(b) by 129 days.

(21) Appl. No.: 09/189,551

(22) Filed: Nov. 11, 1998

Related U.S. Application Data

(63) Continuation of application No. PCT/US98/04655, filed on Mar. 11, 1998.

(60) Provisional application No. 60/058,844, filed on Sep. 15, 1997, provisional application No. 60/048,951, filed on Jun. 5, 1997, provisional application No. 60/041,190, filed on Mar. 21, 1997, provisional application No. 60/040,672, filed on Mar. 11, 1997, and provisional application No. 60/040,673, filed on Mar. 11, 1997.

(51) Int. Cl.[7] ..... B31F 7/00; B31B 49/00

(52) U.S. Cl. ..... 493/464; 493/475; 493/478; 493/967

(58) Field of Search ..... 493/464, 967, 493/476, 475, 478

(56) References Cited

U.S. PATENT DOCUMENTS

| | | | | |
|---|---|---|---|---|
| 2,786,399 A | | 3/1957 | Mason et al. | 493/464 |
| 2,924,154 A | | 2/1960 | Russell et al. | 493/494 |
| 3,337,906 A | | 8/1967 | Kaluza | 452/24 |
| 4,671,047 A | * | 6/1987 | Mugnai | 493/476 |
| 4,674,998 A | * | 6/1987 | Benedicenti | 493/476 |
| 4,750,896 A | | 6/1988 | Komaransky et al. | 493/464 |
| 4,884,999 A | | 12/1989 | Baldacci | 493/967 |
| 4,968,291 A | | 11/1990 | Baldacci et al. | 493/464 |
| 5,061,543 A | | 10/1991 | Baldacci | 428/126 |
| 5,123,889 A | | 6/1992 | Armington et al. | 493/967 |
| 5,188,581 A | | 2/1993 | Baldacci | 493/967 |
| 5,292,238 A | | 3/1994 | Michalak | 53/516 |
| 5,322,477 A | | 6/1994 | Armington et al. | 493/967 |
| 5,799,470 A | * | 9/1998 | Sautter et al. | 493/302 |
| 5,913,766 A | * | 6/1999 | Reed et al. | 493/464 |

* cited by examiner

*Primary Examiner*—Daniel G. DePumpo
*Assistant Examiner*—Matthew Luby
(74) *Attorney, Agent, or Firm*—Renner, Otto, Boisselle & Sklar, LLP

(57) ABSTRACT

A cushioning conversion machine (20) for converting sheet-like stock material (22) into a three-dimensional cushioning product (P) including a device (400; 400'; 500; 600; 600'; 700) which controls the width of the strip and which may be selectively adjusted to change the width of the strip. By selectively setting the device (400, 400', 500; 600; 600'; 700), a cushioning product of a desired width may be produced. For more sophisticated packaging needs, the stock material may be converted into a first portion of a certain width, the device adjusted, and then the stock material may be converted into a second portion of a different width whereby the cushioning product will have continuous portions of different widths. The converting and adjusting steps may be performed sequentially and in such a manner that the cushioning product has discrete sections of different widths, or alternatively, the converting and adjusting steps may be performed substantially simultaneously and in such a manner that the cushioning product has a gradually tapering shape.

58 Claims, 25 Drawing Sheets

CUSHIONING CONVERSION MACHINE AND METHOD

This application is a continuation of PCT/US98/04655, filed Mar. 11, 1998; U.S. Provisional Application No. 60/040,673, filed Mar. 11, 1997; U.S. Provisional Application No. 60/040,672, filed Mar. 11, 1997; U.S. Provisional Application No. 60/041,190, filed Mar. 21, 1997; U.S. Provisional Application No. 60/048,951, filed Jun. 5, 1997; and U.S. Provisional Application No. 60/058,844, filed Sep. 15, 1997.

The present invention relates to a cushioning conversion machine and method in which the cross-sectional geometry of a pad may be selectively varied.

BACKGROUND OF THE INVENTION

In the process of shipping an item from one location to another, a protective packaging material is typically placed in the shipping case, or box, to fill any voids and/or to cushion the item during the shipping process. Some conventional commonly used protective packaging materials are plastic foam peanuts and plastic bubble pack. While these conventional plastic materials seem to adequately perform as cushioning products, they are not without disadvantages. Perhaps the most serious drawback of plastic bubble wrap and/or plastic foam peanuts is their effect on our environment. Quite simply, these plastic packaging materials are not biodegradable and thus they cannot avoid further multiplying our planet's already critical waste disposal problems. The non-biodegradability of these packaging materials has become increasingly important in light of many industries adopting more progressive policies in terms of environmental responsibility.

These and other disadvantages of conventional plastic packaging materials has made paper protective packaging material a very popular alterative. Paper is biodegradable, recyclable and renewable; making it an environmentally responsible choice for conscientious industries. While paper in sheet form could possibly be used as a protective packaging material, it is usually preferable to convert the sheets of paper into a relatively low density pad-like cushioning dunnage product. This conversion may be accomplished by a cushioning conversion machine, such as that disclosed in U.S. Pat. No. 5,322,477. (This patent is assigned to the assignee of the present application and its entire disclosure is hereby incorporated herein by reference.)

In a cushioning conversion machine which forms sheet-like stock material into a continuous strip, the cross-sectional geometry (i.e., the width) of the strip essentially dictates the cross-sectional geometry (i.e., the width) of the resulting cushioning product. For example, in the cushioning conversion machine disclosed in U.S. Pat. No. 5,322,477, the cross-sectional geometry of the cushioning product, and specifically its width, is determined by the machine's forming assembly, and more particularly a chute, and even more particularly, the exit end of the chute.

In the commercial embodiments of the cushioning conversion machine disclosed in U.S. Pat. No. 5,322,477, the cushioning product is about 8 to 10 inches in width. This pad size is acceptable and suitable, and even preferred, for many packaging applications. However, occasionally, a slightly smaller width pad (i.e., 7½ inches) is required to accommodate certain packaging applications. Additionally, especially in sophisticated packaging systems, pads of differing widths may be required, or at least desired, to package articles of differing dimensions and shapes.

U.S. Pat. Nos. 4,884,999; 5,061,543 and 5,188,581 disclose a cushioning conversion machine/method for making a cushioning product having a width of about 3½ to 4 inches. The disclosed machine/method is the result of a revamping of a "standard" cushioning conversion machine into a machine capable of producing the relatively narrow cushioning product from fifteen-inches wide (as opposed to the thirty-inch wide) stock material. This revamping is accomplished by a kit which includes a funnel member, substantially smaller in cross-sectional dimensions than the converging chute, and an elongated bar-like member. To revamp the machine, the forming frame would be removed, as it is not used to produce the narrow width cushioning product. The converging chute would likewise not be used during the narrow width pad production, but it could either be left on the machine or removed. The components of the kit (the narrow funnel member and the bar-like member) are then installed on the machine, and once installed, the revamped machine can be used to produce narrow width pads. If it is desired to return to the original sized pads, the kit components are removed and replaced with the original components to return the machine to full size production.

Thus, in the past, to the extent that the cross-sectional geometry of a cushioning pad has been changed, this change was accomplished by the replacement of forming assembly components. Thus, if a different width pad (i.e., 7½ inches, 7 inches, 6½ inches, 6 inches, 5½ inches, etc.) is required, an alternate forming assembly would have to be supplied, for each desired pad width. Needless to say, the complications of such a system would place a strain on machine manufacture. Also, continuous revamping of machines to provide different width pads would not be able to accommodate sophisticated packaging systems which require pads of differing widths to package articles of differing dimensions and shapes.

SUMMARY OF THE INVENTION

The present invention provides a cushioning conversion machine including a device for selectively adjusting the cross-sectional geometry of a cushioning pad produced by a cushioning conversion machine. This adjustment may be accomplished without the replacement of forming assembly components and allows a large range of adjustments. Additionally or alternatively, the cushioning conversion machine is able to accommodate sophisticated packaging systems which require pads of differing widths to package articles of differing dimensions and shapes.

In the preferred form of the invention, the cushioning conversion machine comprises a forming assembly which forms sheet-like stock material into a strip; a feed assembly which advances the stock material through the forming assembly; and a device which controls the width of the strip and which may be selectively adjusted to change the width of the strip.

The preferred device includes a pair of guide members and a mounting assembly mounting the guide members relative to the machine's frame. The preferred forming assembly includes a chute and the preferred feed assembly includes a pair of rotating feed members. The mounting assembly positions the guide members between the output of the chute and the rotating feed members and allows selective adjustment of the spacing between the guide members.

The mounting assembly preferably allows selective adjustment of the guide member spacing between a distance which is the same or greater than the width of the exit end of the chute and a distance which is less than the width of the exit end of the chute. More preferably, the mounting assembly allows selective adjustment of the guide member spacing to a plurality of distances which are less than the width of the exit end of the chute.

In certain preferred embodiments of the invention, the guide members are rollers which are rotatably mounted on the mounting assembly whereby they may freely turn as the strip passes therethrough. The rollers have a concave shape and more specifically have a spool shape with an axial dimension approximately equal to the height of the exit end of the chute and positioned to surround the lateral edges of the strip as it emerges from the chute. In another preferred embodiment, the mounting assembly is fixed relative to the machine's frame and the guide members are selectively positionable on (although non-rotatably supported by) the fixed mounting assembly.

In certain preferred forms of the invention, the pad-adjustment device includes at least one adjustment member which is moved among a plurality of positions to change the width of the strip and the device includes a motorized drive, such as a reversible rotary motor, which moves the adjustment member among the plurality of positions. The cushioning conversion machine may additionally comprise a control system for controlling the motorized drive to move the adjustment member among the plurality of positions.

In a preferred method of converting sheet-like stock material into a three-dimensional cushioning product according to the present invention, the sheet-like stock material is supplied to the cushioning conversion machine. The stock material is converted into a strip of a certain width, the pad-adjustment device is adjusted, and the stock material is converted into a strip of different width. Such a method will produce a cushioning product according to the present invention which has continuous portions of different widths. The converting and adjusting steps may be performed sequentially and in such a manner that the cushioning product according to the present invention has discrete sections of different widths. Alternatively, the converting and adjusting steps may be performed substantially simultaneously and in such a manner that the cushioning product according to the present invention has a gradually tapering shape.

In another preferred method of converting sheet-like stock material into a three-dimensional cushioning product according to the present invention, sheet-like stock material is formed into a first strip of a certain width by inwardly turning the lateral edges of the sheet-like stock material and then the first strip is formed into another strip of a less width by inwardly turning the outer lateral sides of the first strip. The second forming step may be accomplished by a pad-adjustment device according to the present invention. In any event, a cushioning product is produced which comprises two lateral pillow-like portions, each including inwardly turned lateral edges of the sheet-like stock material which have once again been inwardly turned.

DRAWINGS

DETAILED DESCRIPTION

Figure 1:
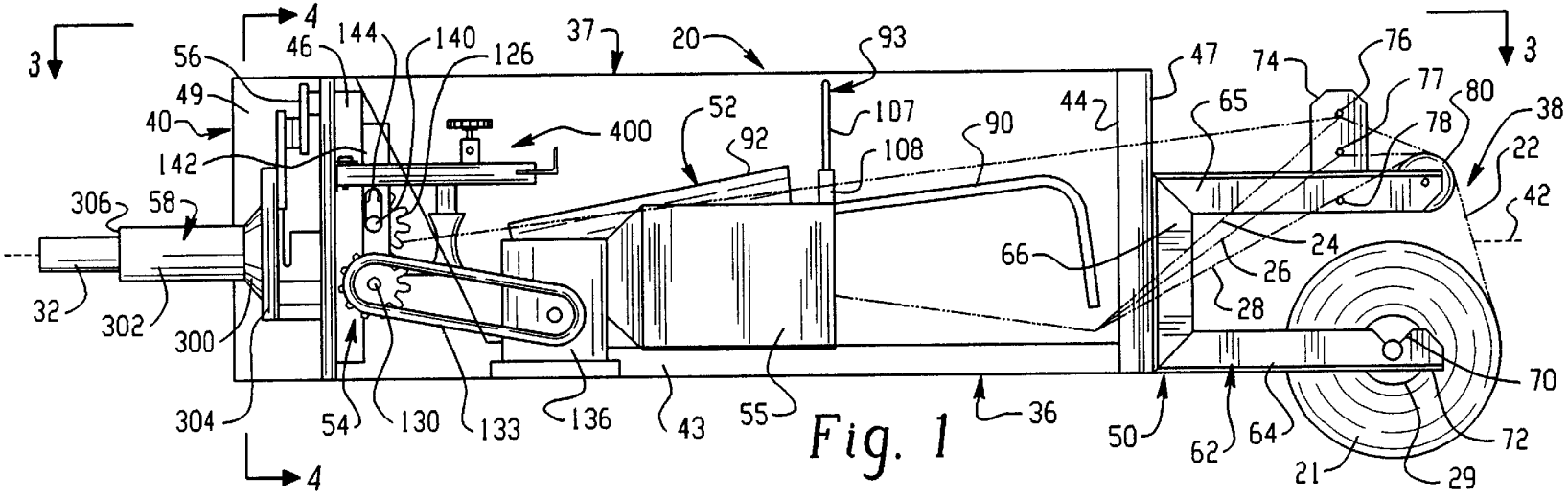
FIG. 1 is a side view of the cushioning conversion machine 20 incorporating an adjustment device 400 according the present invention, the the machine being shown positioned in a horizontal manner, loaded with stock material, and with an outer housing side wall removed for clarity of illustration.
Figure 2:
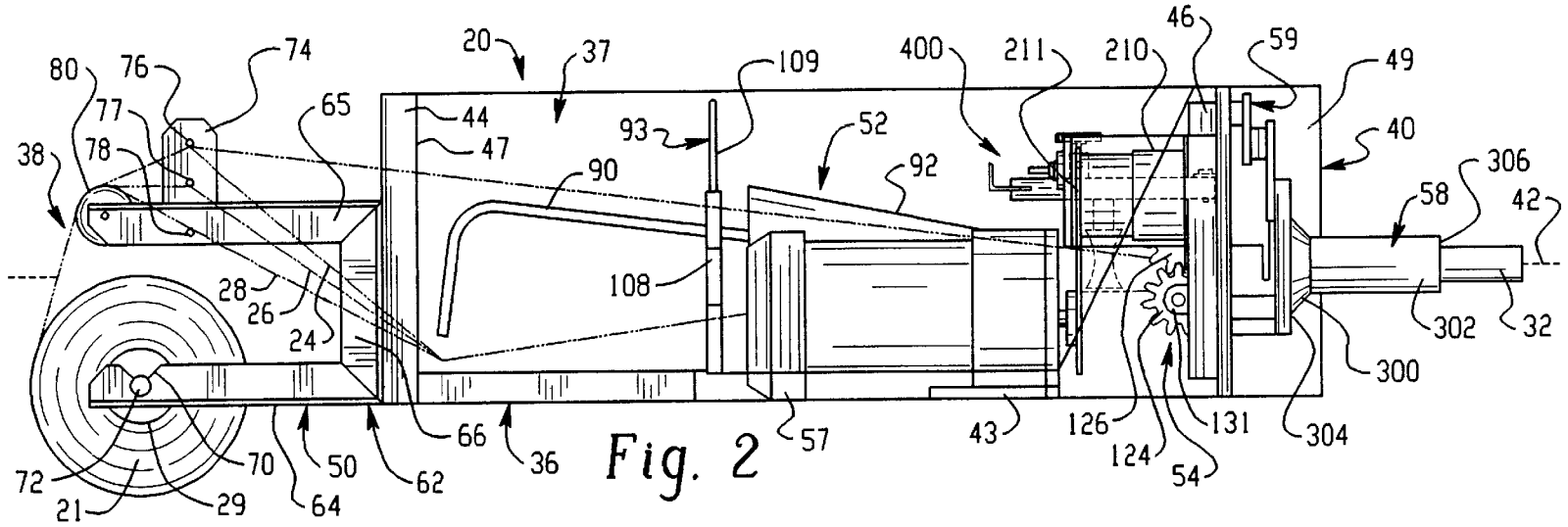
FIG. 2 is an opposite side view of the cushioning conversion machine 20.
Figure 3:
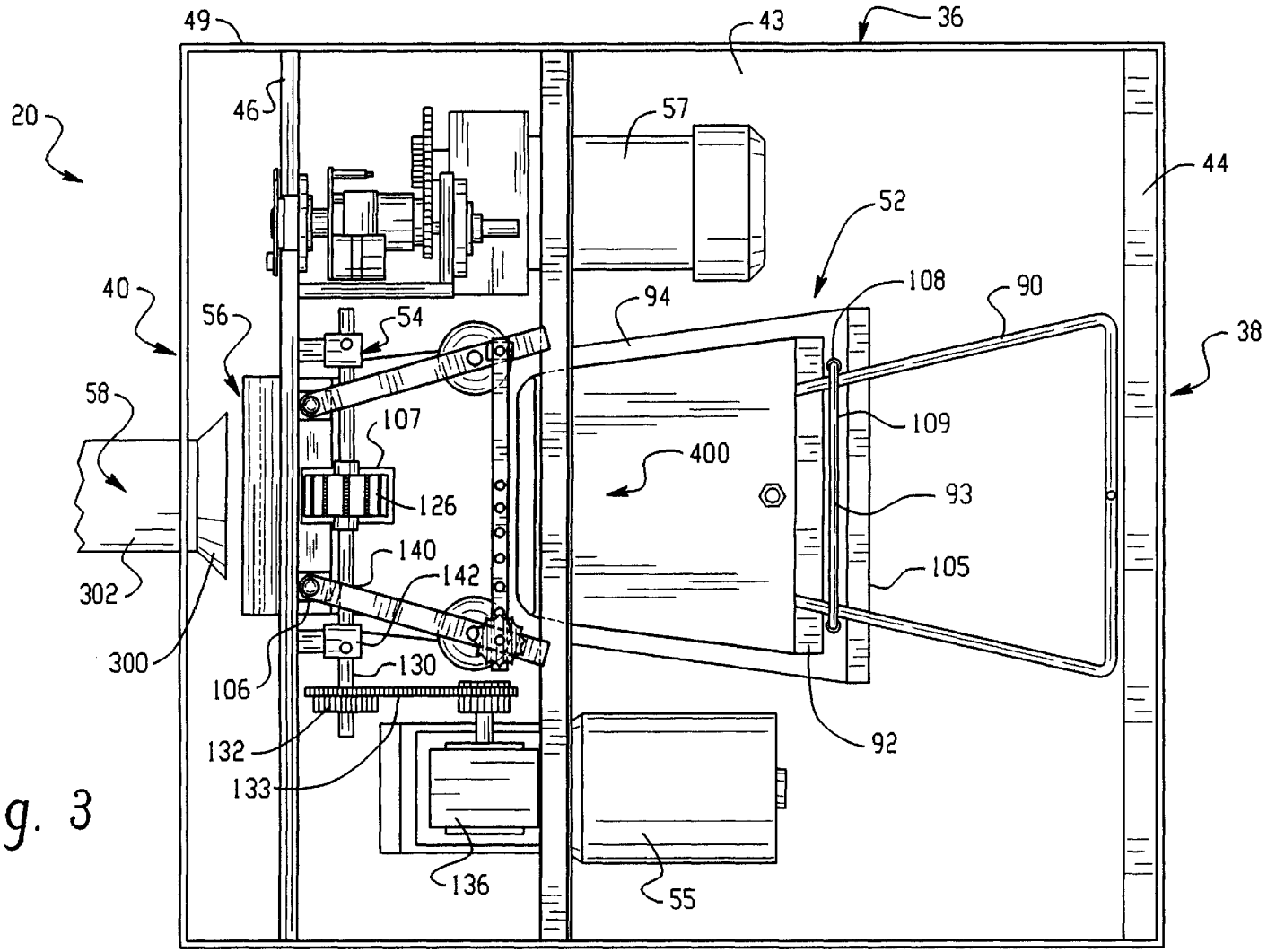
FIG. 3 is a top plan view of the cushioning conversion machine 20, without stock material being loaded and as seen along line 3—3 in FIG. 1.
Figure 4:
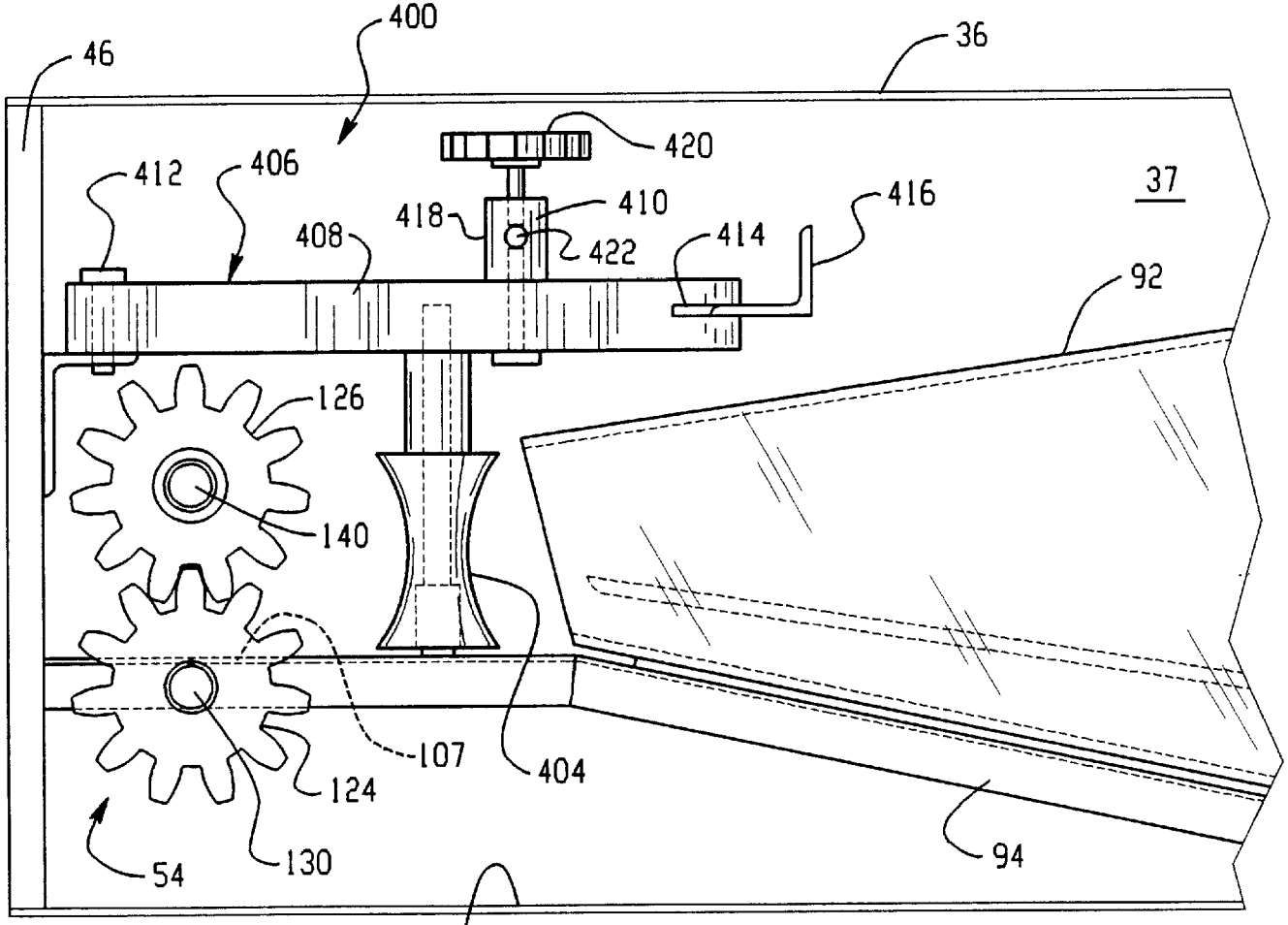
FIG. 4 is a schematic side view of the adjustment device 400.
Figure 5:
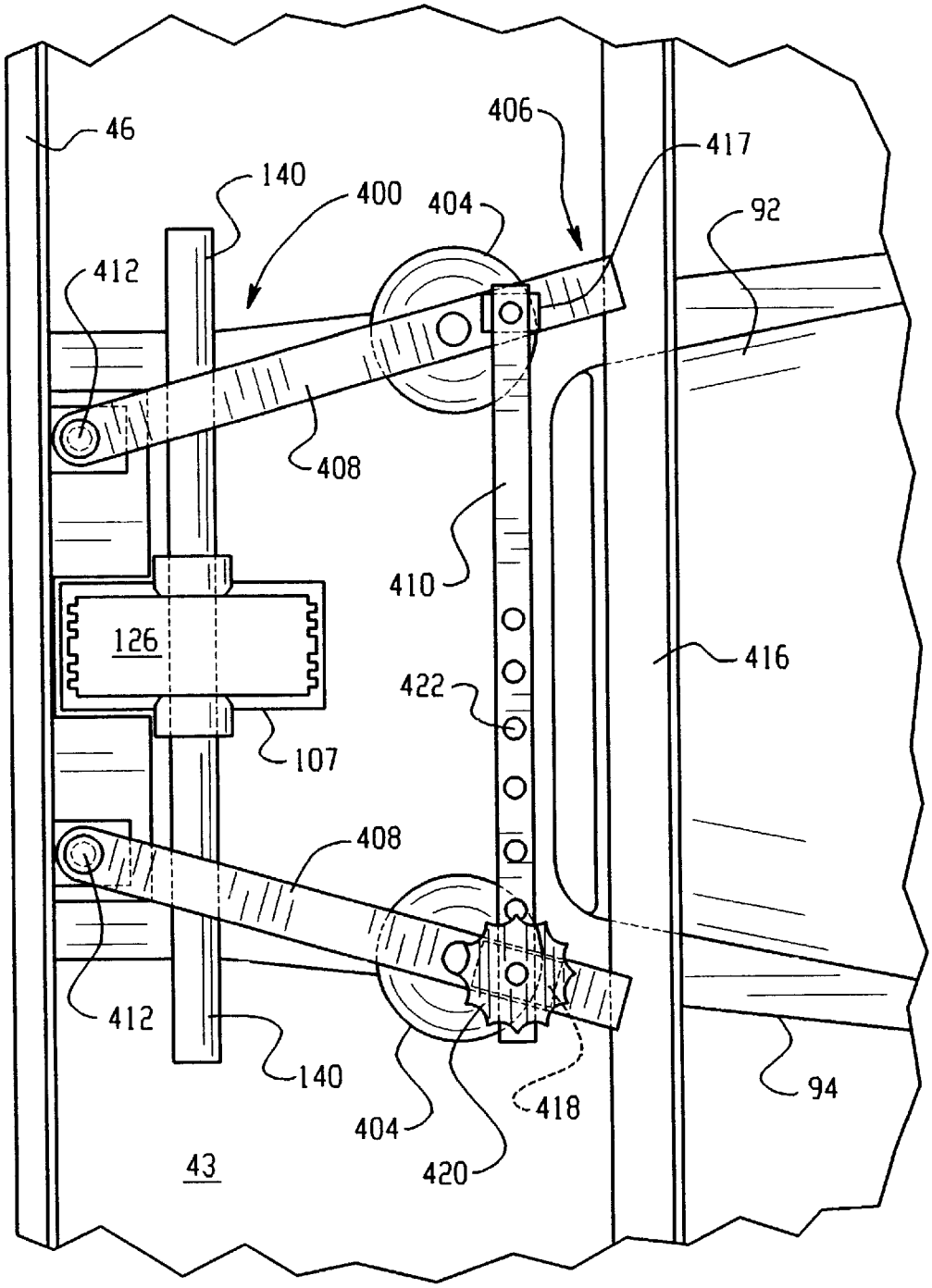
FIG. 5 is a schematic top view of the adjustment device 400, the device being shown positioned so that the cushioning conversion machine 20 will produce a maximum width pad.
Figure 6:
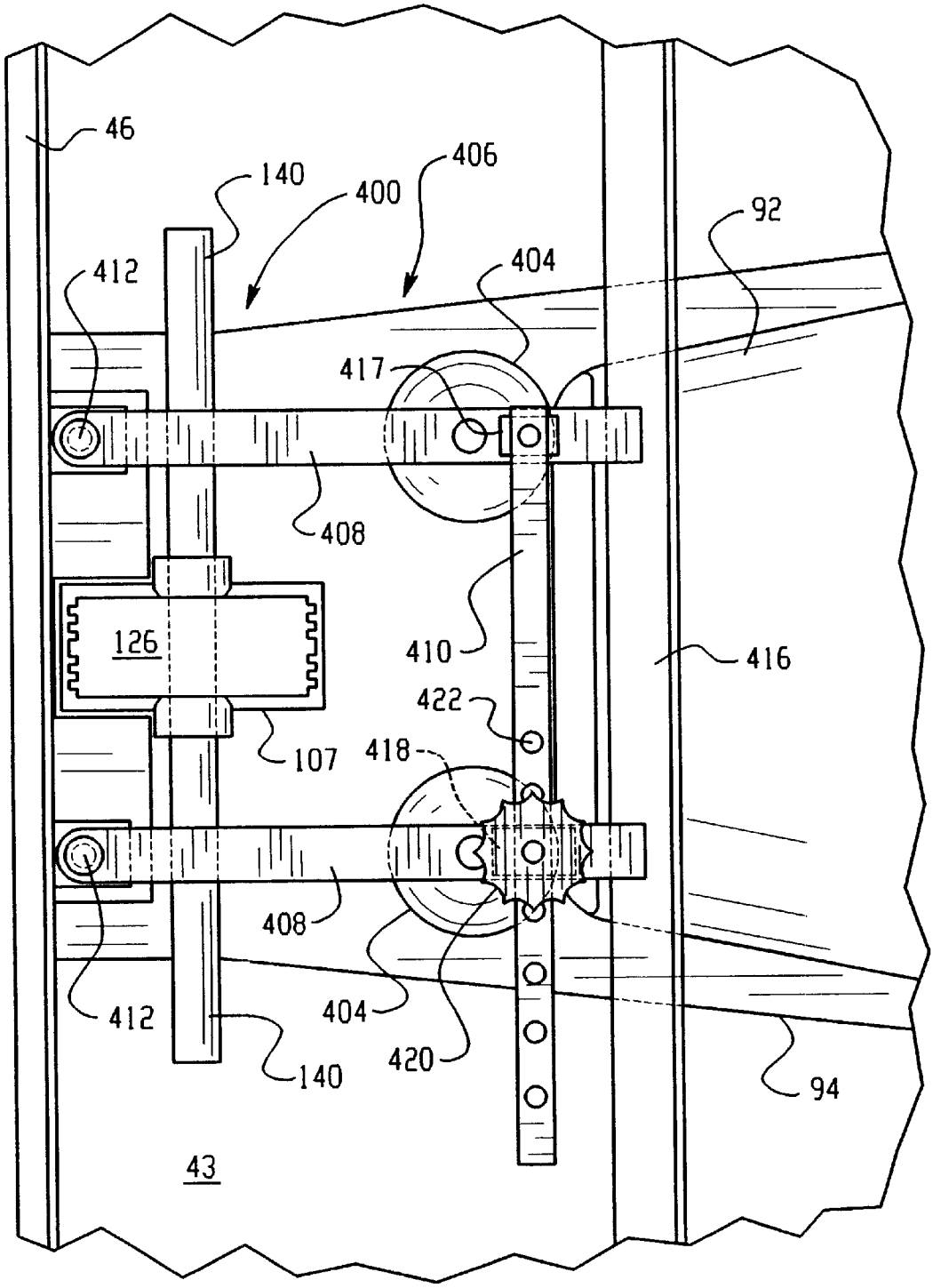
FIG. 6 is a schematic top view of the adjustment device 400, the device being shown positioned so that the cushioning conversion machine 20 will produce an intermediate width pad.
Figure 7:
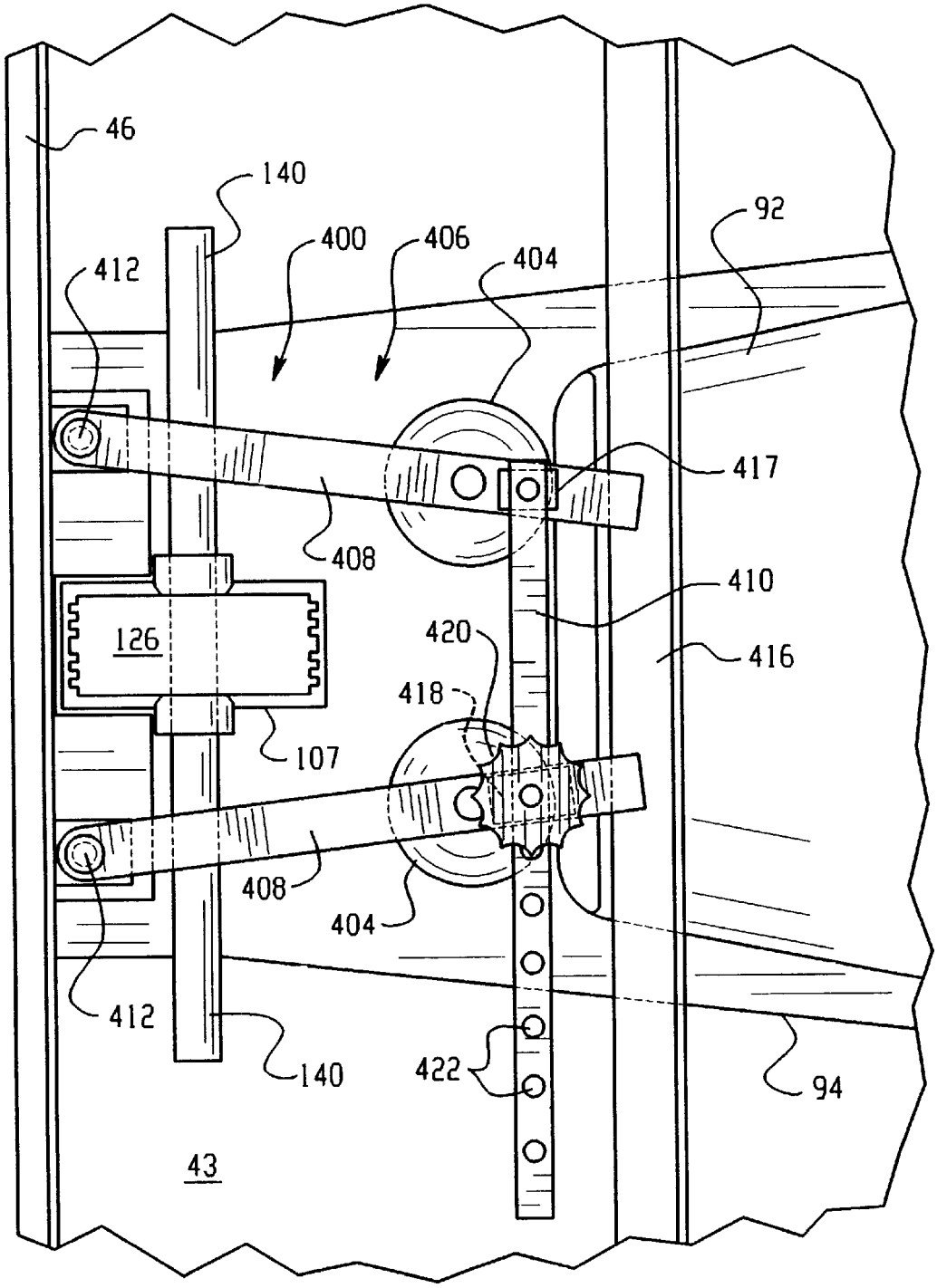
FIG. 7 is a schematic top view of the adjustment device 400, the device being shown positioned so that the cushioning conversion machine 20 will produce a narrow pad.
Figure 8:
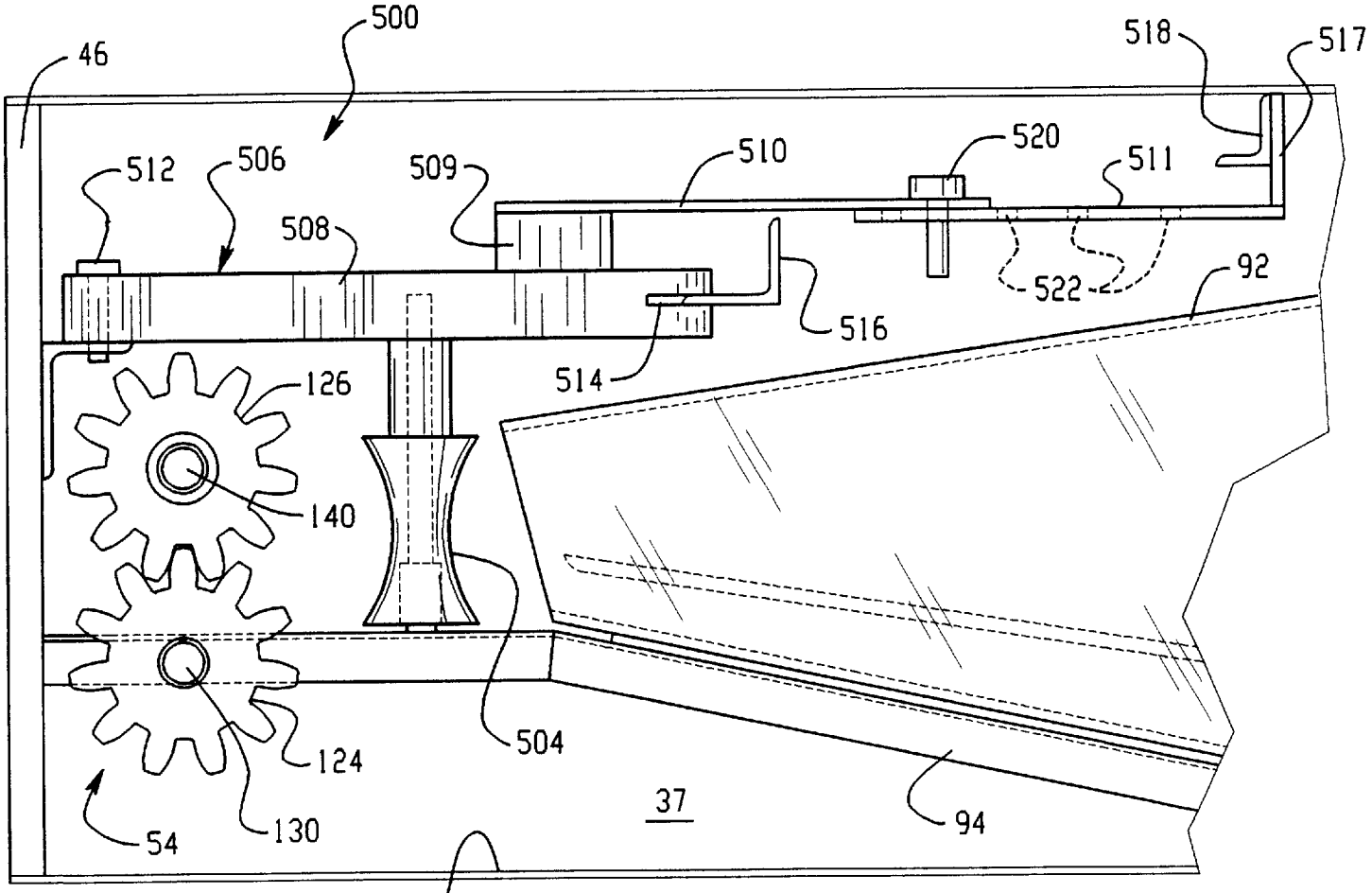
FIG. 8 is a schematic side view of another adjustment device 500 according the present invention which may be incorporated in the cushioning conversion machine 20.
Figure 9:
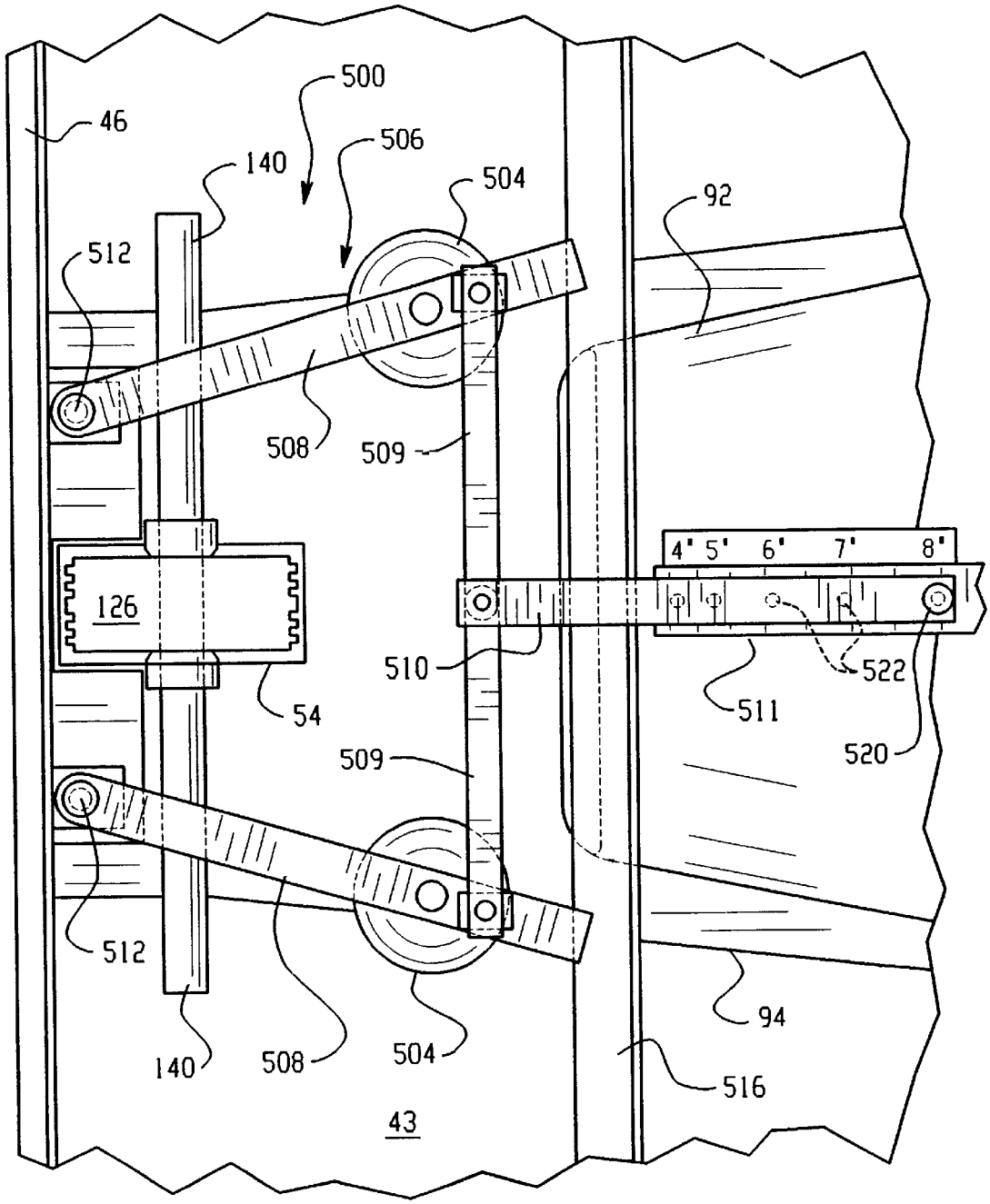
FIG. 9 is a schematic top view of the adjustment device 500, the device being shown positioned so that the cushioning conversion machine 20 will produce a maximum width pad.
Figure 10:
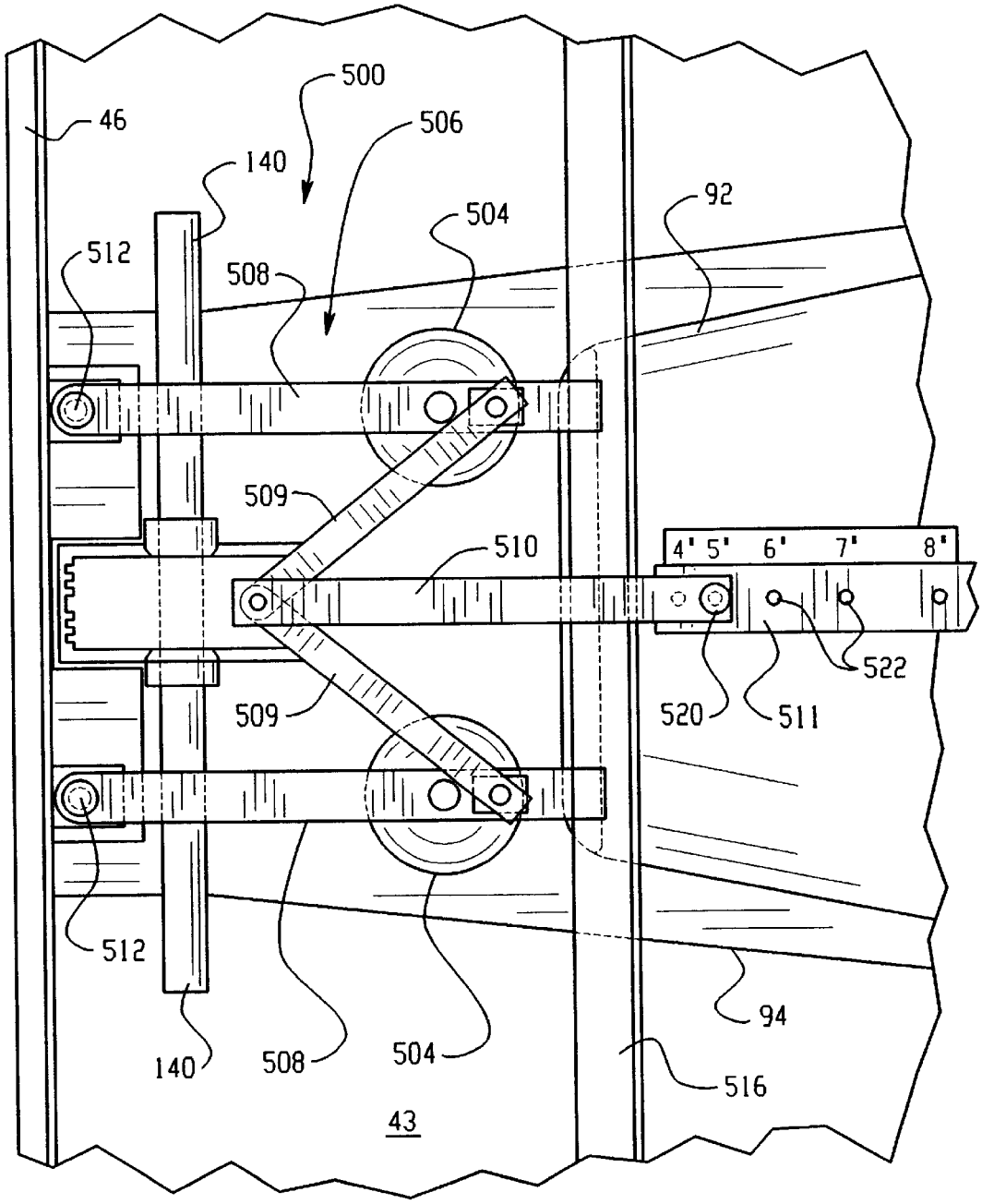
FIG. 10 is a schematic top view of the adjustment device 500, the device being shown positioned so that the cushioning conversion machine 20 will produce an intermediate width pad.
Figure 11:
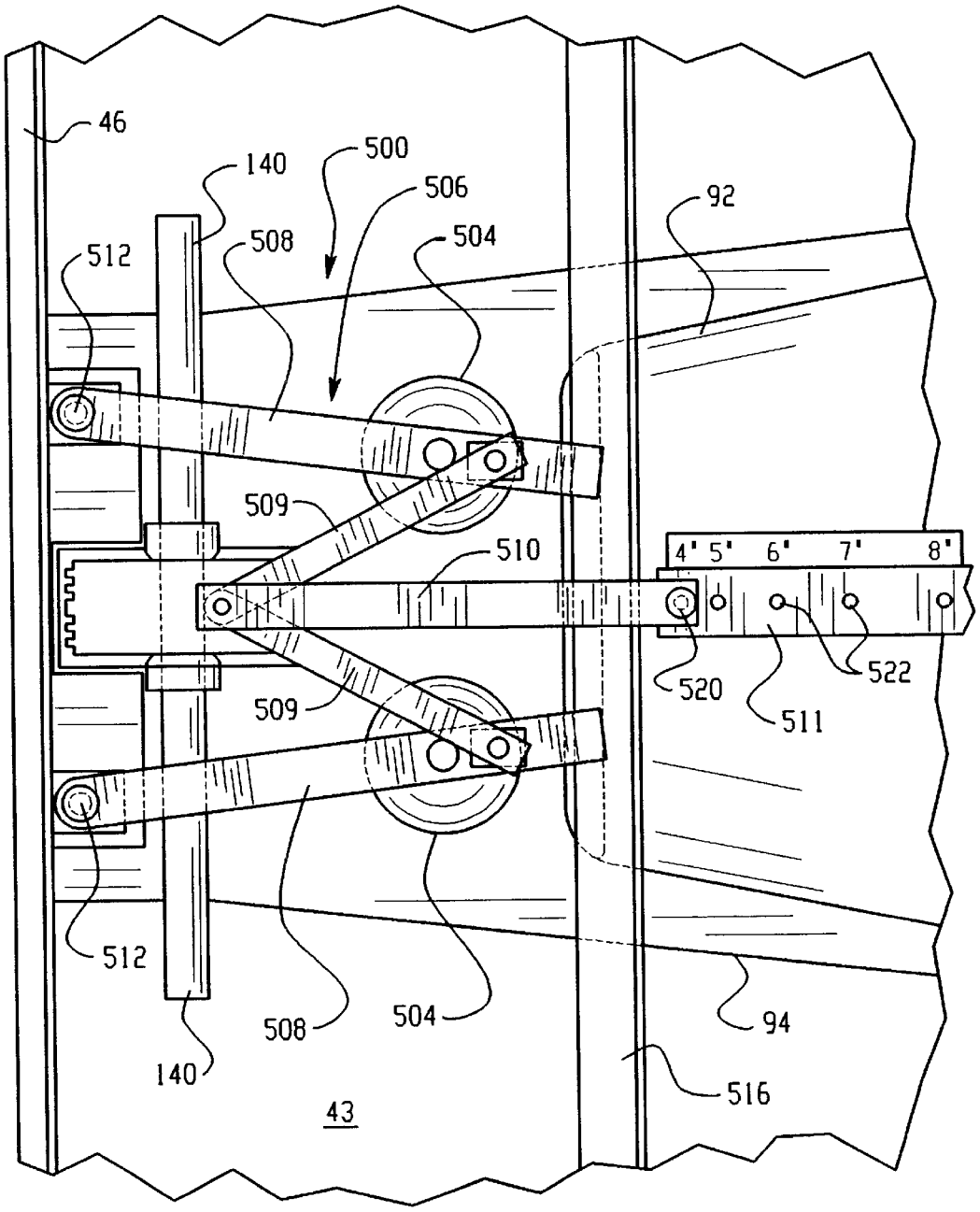
FIG. 11 is a schematic top view of the adjustment device 500, the device being shown positioned so that the cushioning conversion machine 20 will produce a narrow pad.
Figure 12:
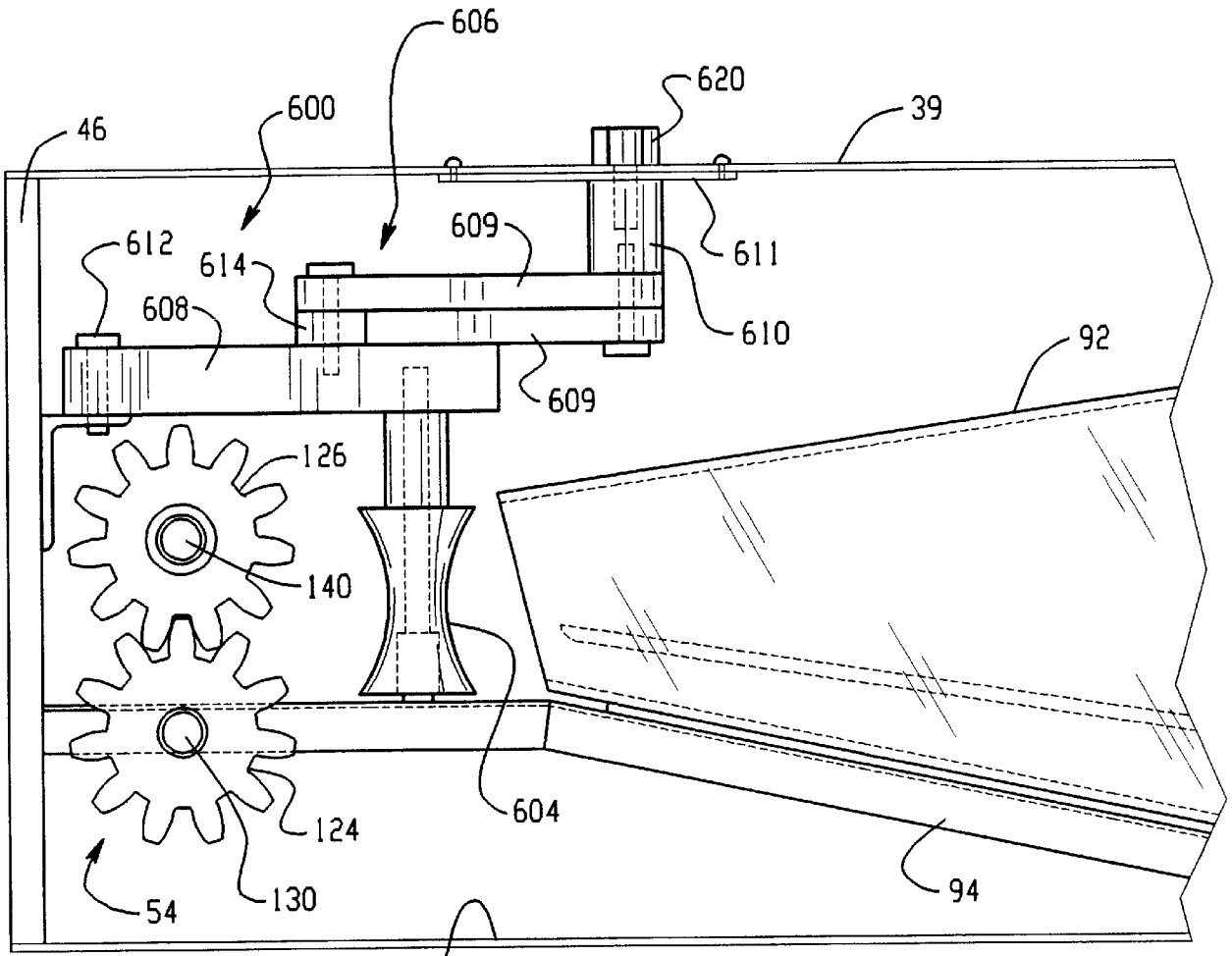
FIG. 12 is a schematic side view of another adjustment device 600 according the present invention which may be incorporated into the cushioning conversion machine 20.
Figure 13:
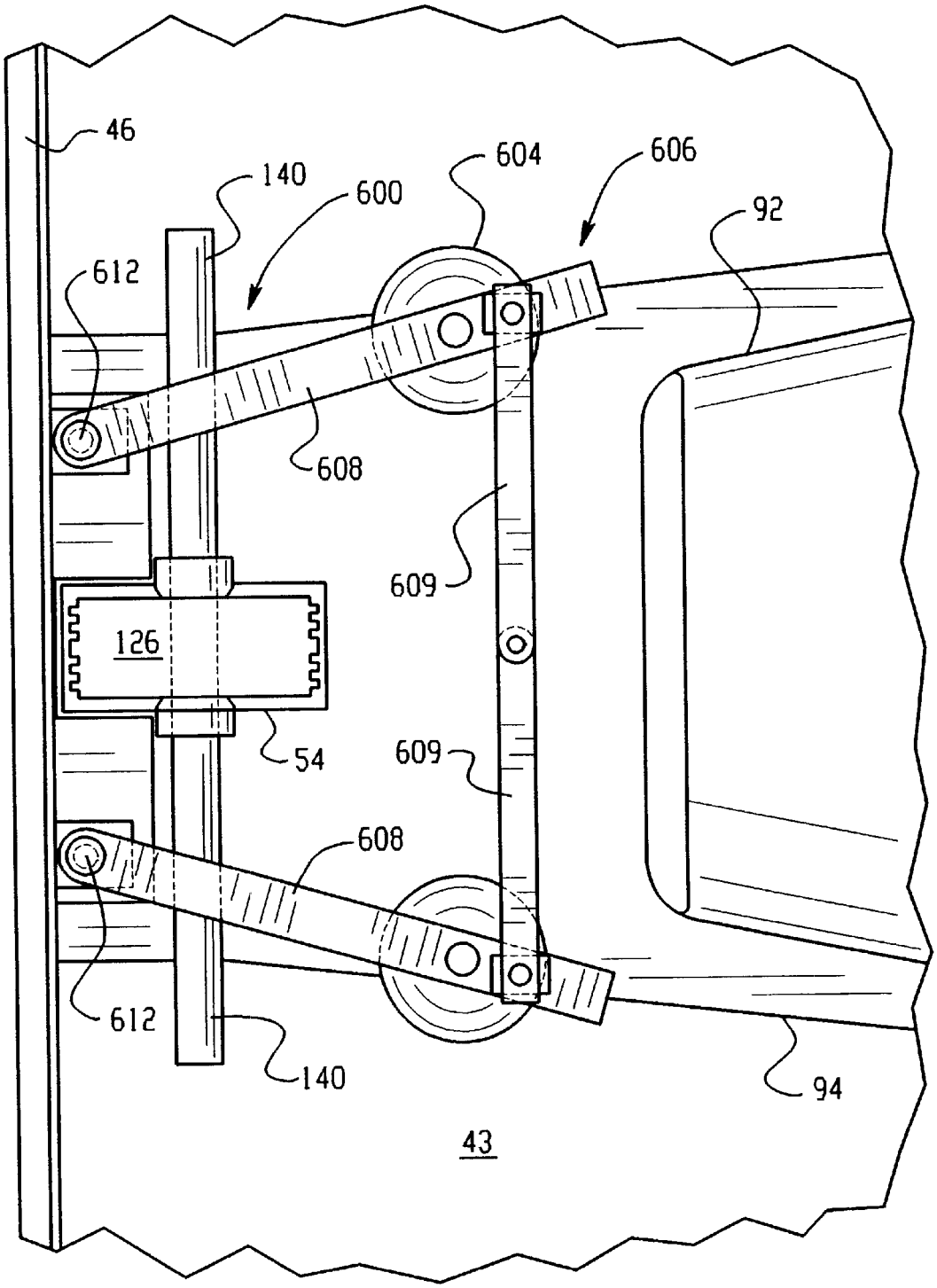
FIG. 13 is a schematic top view of the adjustment device 600, the device being shown positioned so that the cushioning conversion machine 20 will produce a maximum width pad.
Figure 14:
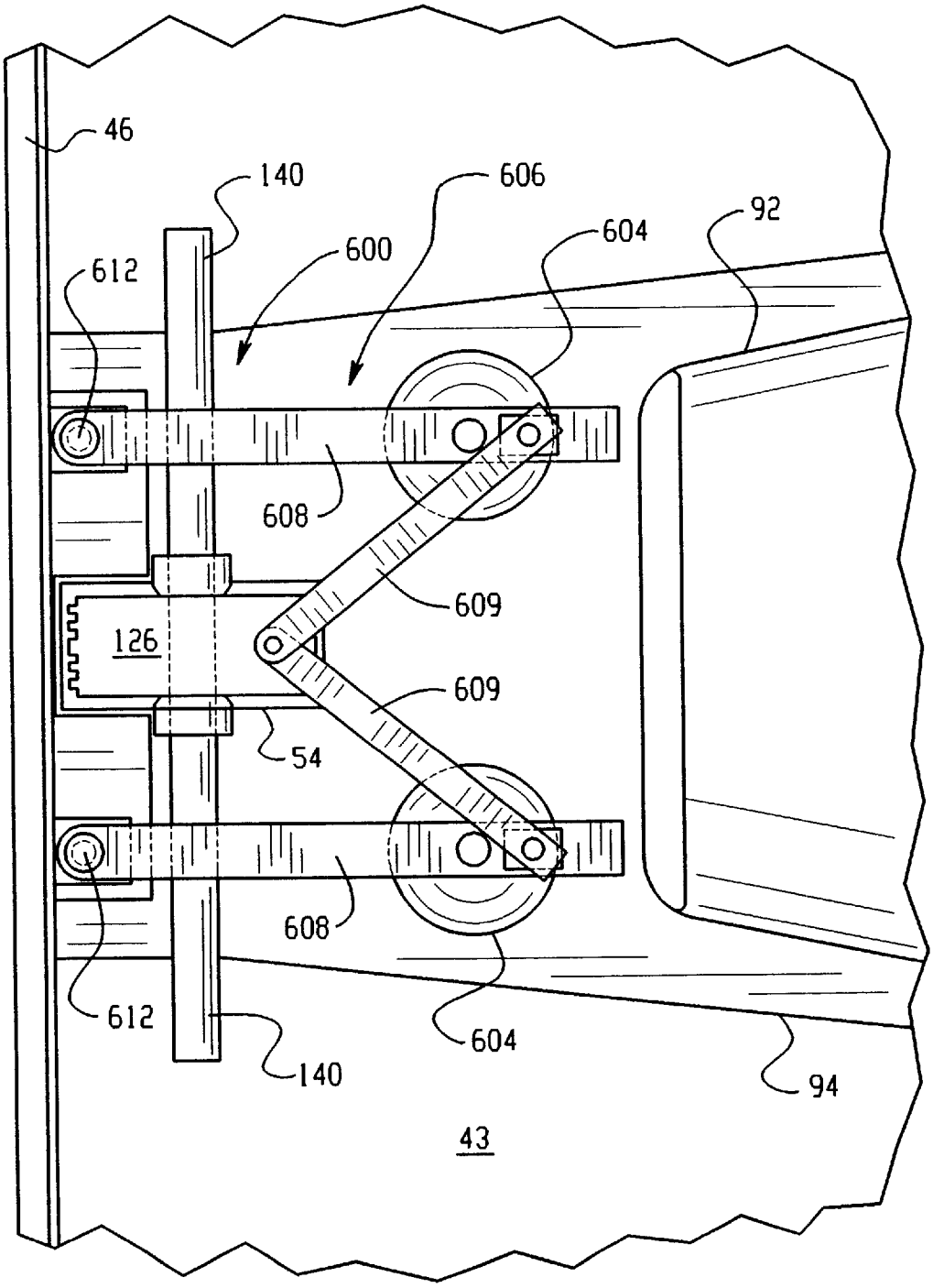
FIG. 14 is a schematic top view of the adjustment device 600, the device being shown positioned so that the cushioning conversion machine 20 will produce an intermediate width pad.
Figure 15:
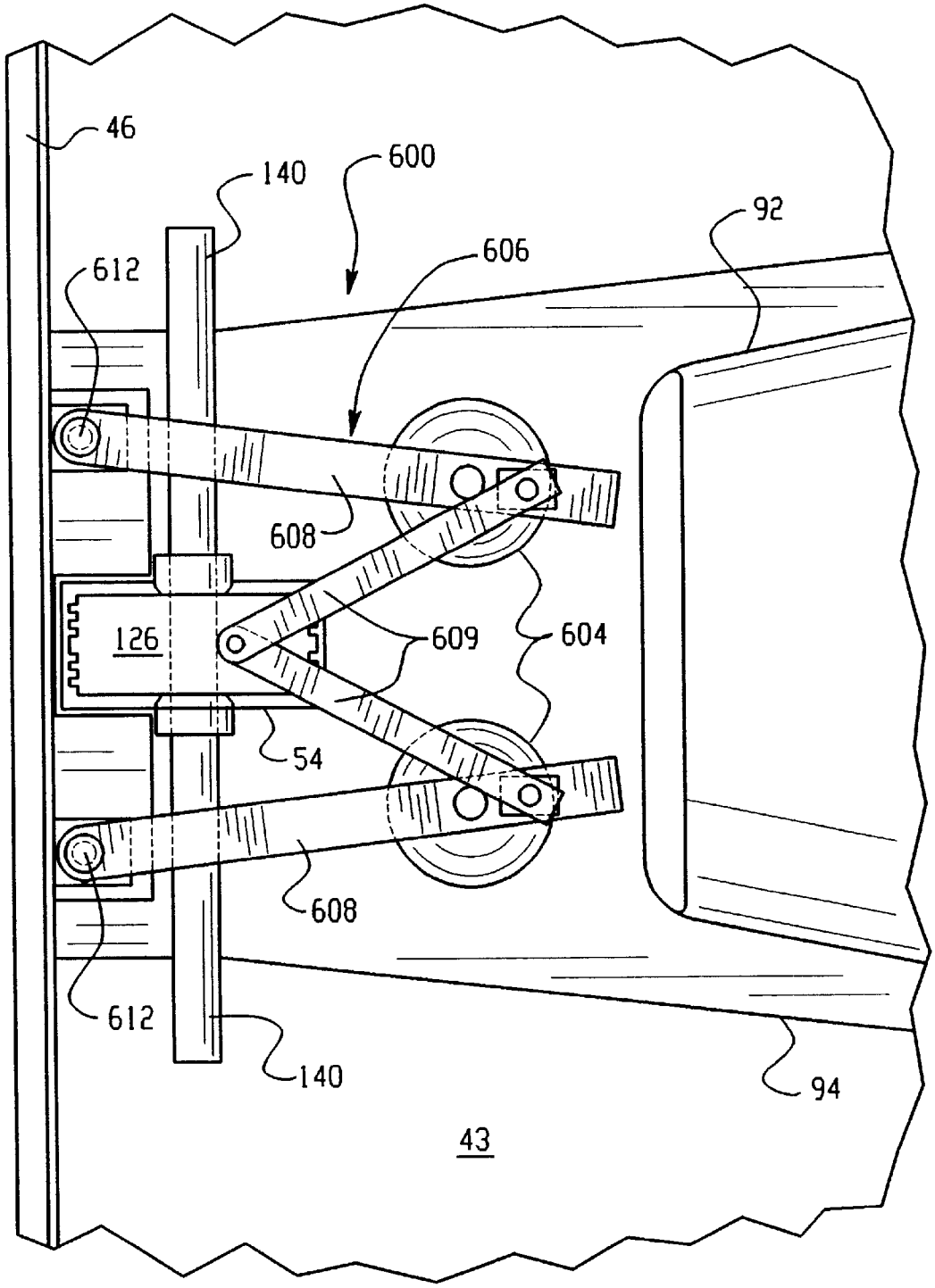
FIG. 15 is a schematic top view of the adjustment device 600, the device being shown positioned so that the cushioning conversion machine 20 will produce a narrow pad.
Figure 16:
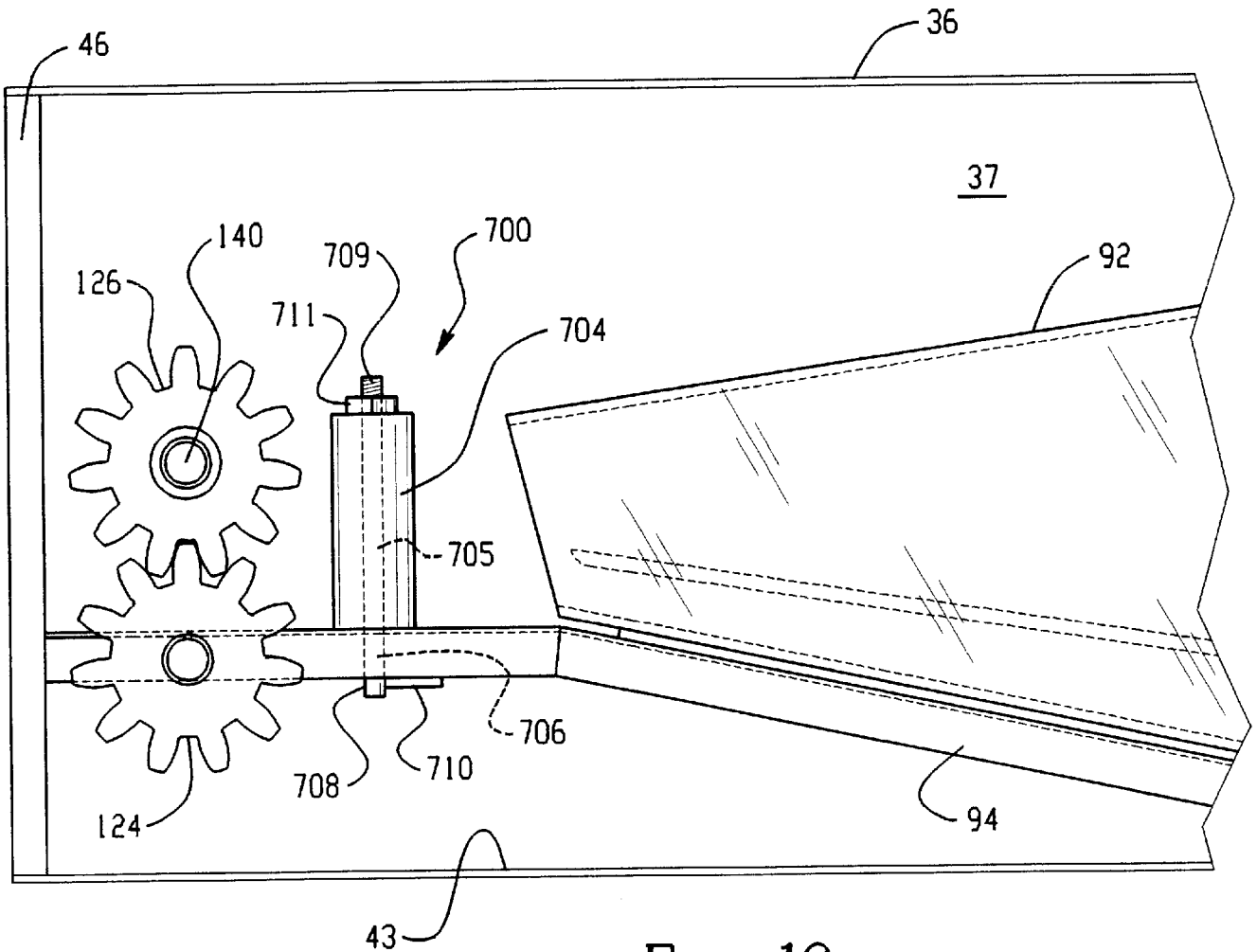
FIG. 16 is a schematic side view of another adjustment device 700 according the present invention which may be incorporated into the cushioning conversion machine 20.
Figure 17:
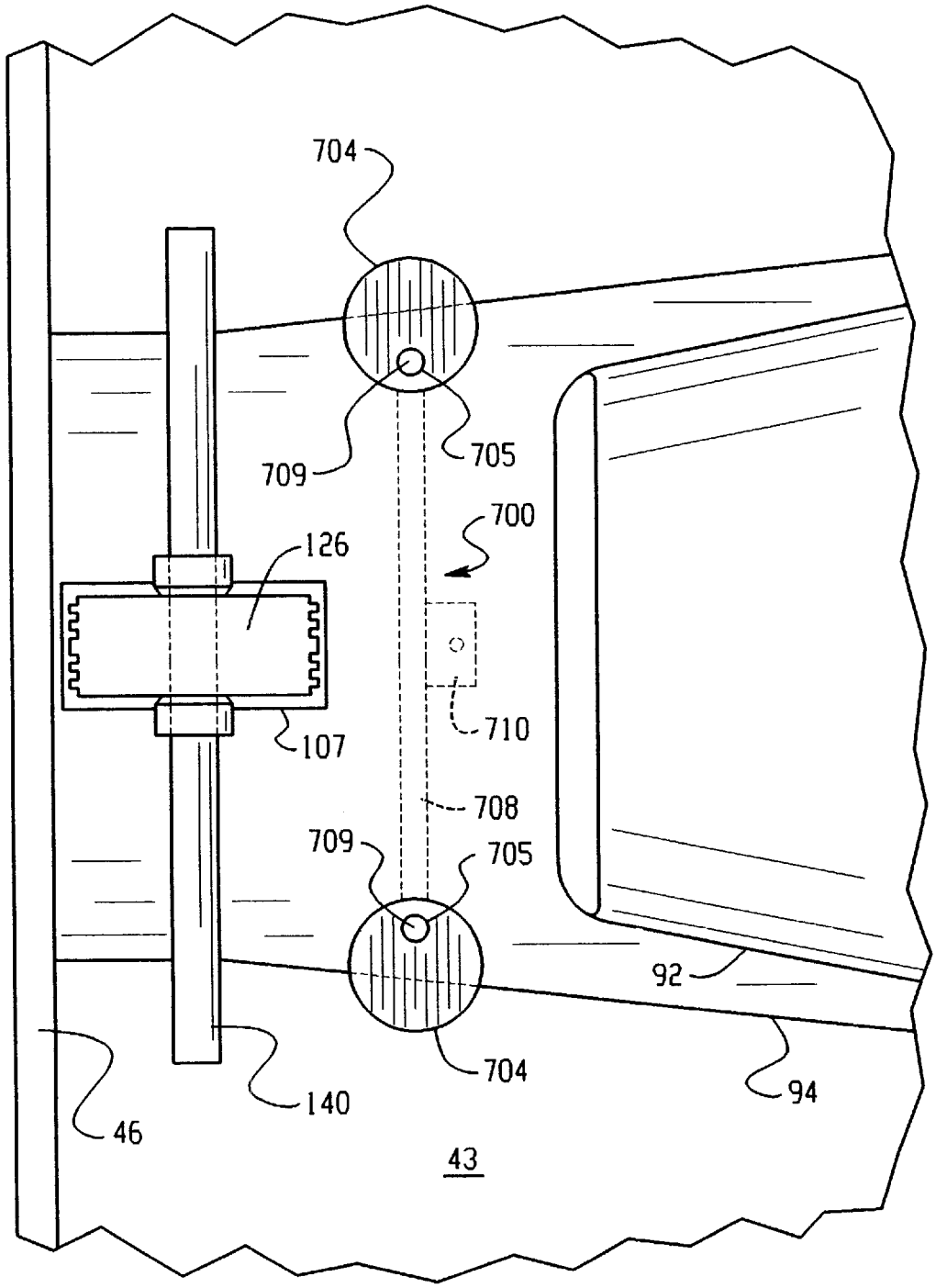
FIG. 17 is a schematic top view of the adjustment device 700, the device being shown positioned so that the cushioning conversion machine 20 will produce a maximum width pad.
Figure 18:
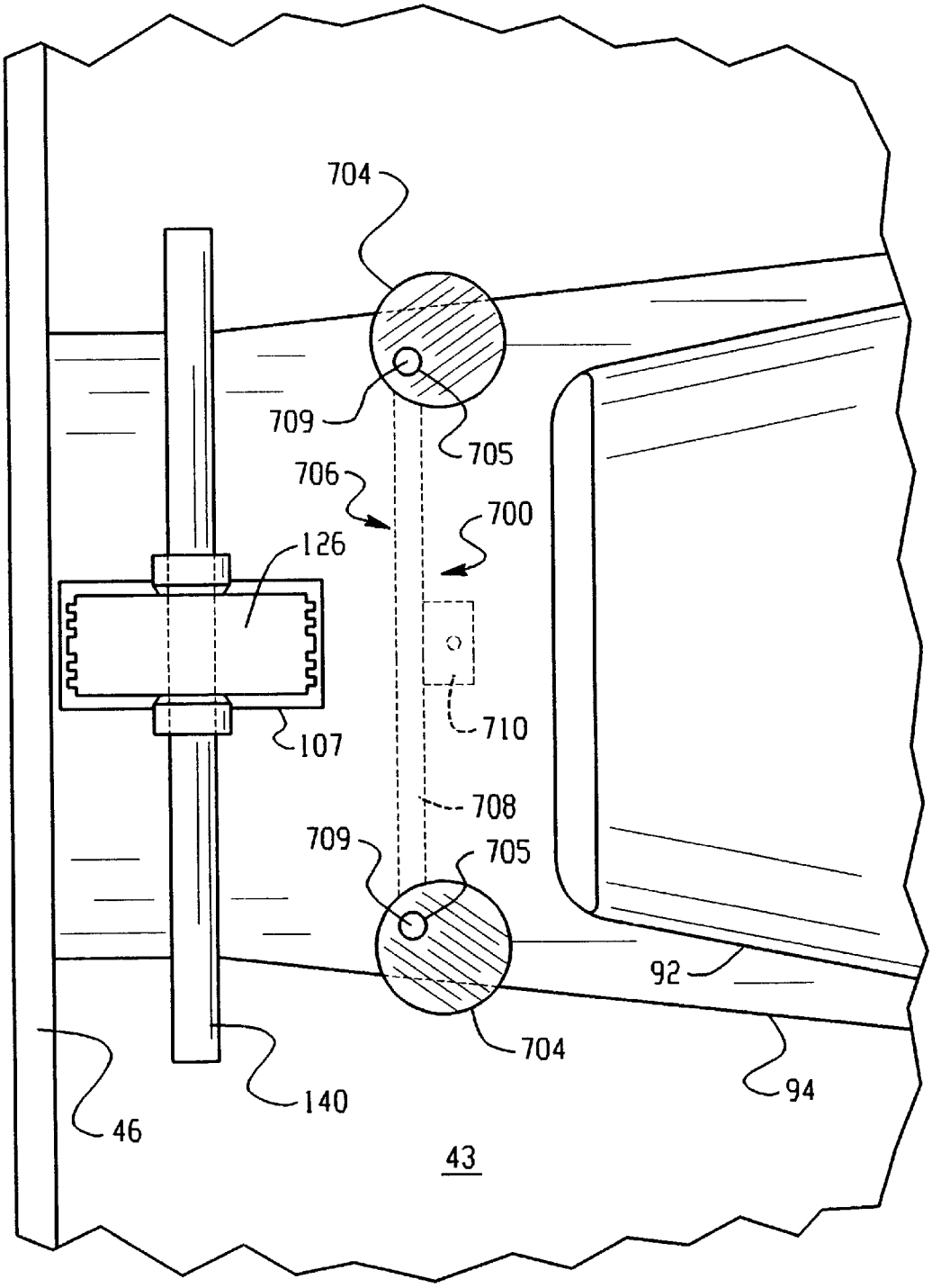
FIG. 18 is a schematic top view of the adjustment device 700, the device being shown positioned so that the cushioning conversion machine 20 will produce an intermediate width pad.
Figure 19:
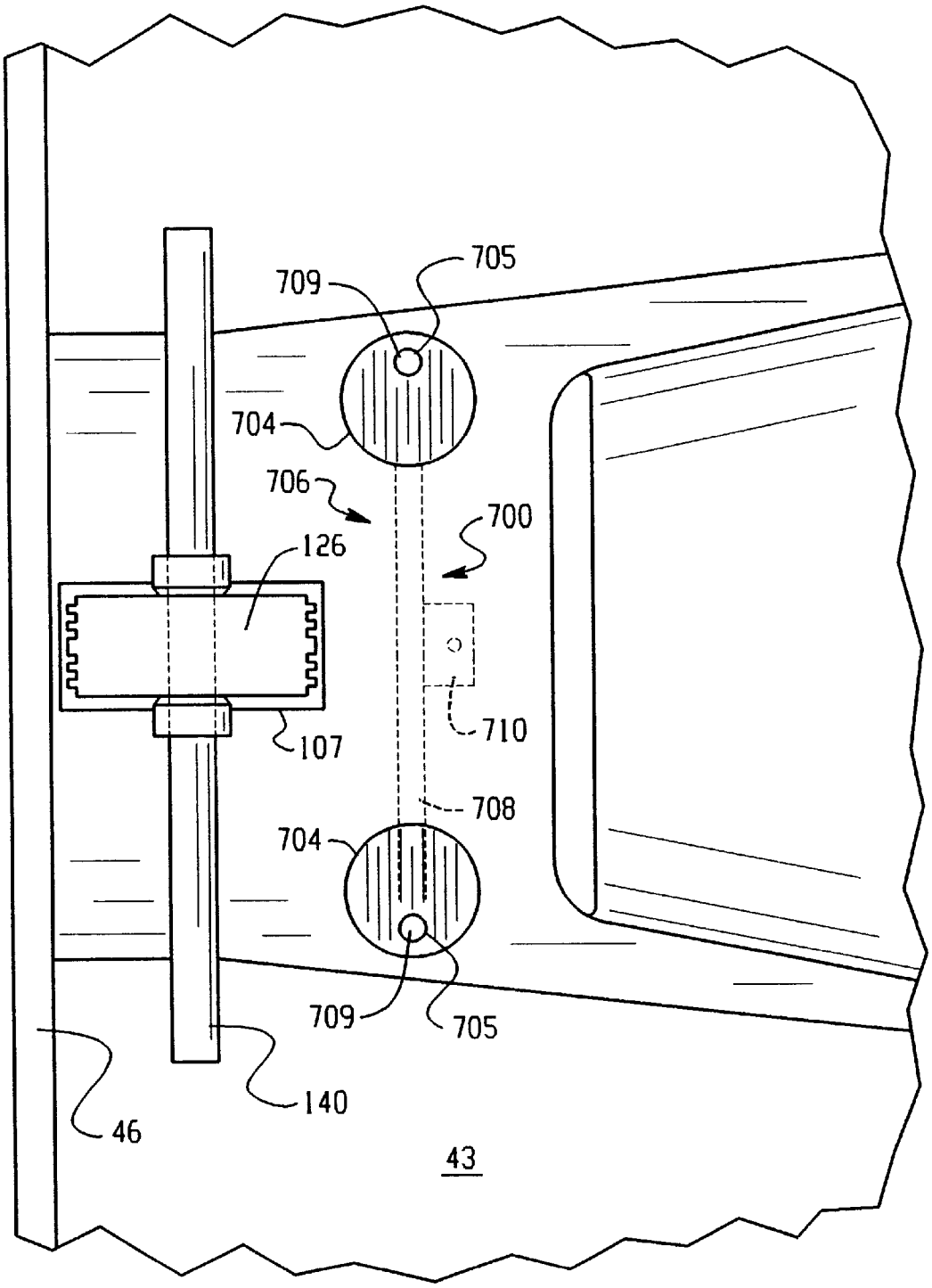
FIG. 19 is a schematic top view of the adjustment device 700, the device being shown positioned so that the cushioning conversion machine 20 will produce a narrow pad.

Referring now to the drawings in detail, and initially to FIGS. 1–3, a cushioning conversion machine 20 incorporating a pad adjustment device 400 according to the present invention is shown. The illustrated machine 20 is similar to that disclosed in U.S. Pat. No. 5,322,477. However, an adjustment device according to the present invention may be incorporated into any cushioning conversion machine or method which falls within the scope of the claims. For example, the device may be incorporated into a cushioning conversion machine as set forth in U.S. Pat. No. 4,968,291, (list senior junior, etc.)

As is explained in more detail below, the pad adjustment device 400 is a a device for selectively adjusting the cross-sectional geometry of a cushioning pad produced by a cushioning conversion machine 20, particularly the width of the cushioning pad in the preferred embodiments. The pad-width adjustment may be accomplished without the replacement of forming assembly components and allows a large range of adjustments. Additionally or alternatively, the cushioning conversion machine 20 is able to accommodate sophisticated packaging systems which require pads of differing widths to package articles of differing dimensions and shapes.

In FIGS. 1 and 2, the cushioning conversion machine 20 is shown positioned in a horizontal manner and loaded with a roll 21 of sheet-like stock material 22. The stock material 22 may consist of three superimposed webs or layers 24, 26, and 28 of biodegradable, recyclable and reusable thirty-pound Kraft paper rolled onto a hollow cylindrical tube 29. A thirty-inch roll of this paper, which is approximately 450 feet long, will weigh about 35 pounds and will provide cushioning equal to approximately four 15 $ft^8$ bags of plastic foam peanuts while at the same time requiring less than one-thirtieth the storage space.

The machine 20 converts this stock material 22 into a continuous unconnected strip having lateral pillow-like portions separated by a thin central band. This strip is connected along the central band to form a connected strip which is cut into sections 32 of a desired length. The cut sections 32 each include lateral pillow-like portions 33 separated by a thin central band and provide an excellent relatively low density pad-like product which may be used instead of conventional plastic protective packaging material.

The machine 20 includes a housing, indicated generally at 36, having an upstream or "feed" end 38 and a downstream or "discharge" end 40. The terms "upstream" and "downstream" in this context are characteristic of the direction of flow of the stock material 22 through the machine 20. The housing 36 is positioned in a substantially horizontal manner whereby an imaginary longitudinal line or axis 42 from the upstream end 38 to the downstream end 40 would be substantially horizontal.

The housing 36 includes side walls 37, a top or cover wall 39, a base plate or wall 43 and two end walls 44 and 46. The frame base wall 43 is generally rectangular and extends from the upstream end 38 to the downstream end 40 of the housing 36 in a generally horizontal plane. Although not perfectly apparent from the illustrations, the first or upstream wall 44 may be more specifically described as a thin rectangular wall having a rectangular stock inlet opening 47 passing therethrough. Alternatively, instead of the end wall 44, the side and base walls 37 and 43 may have upstream inwardly turned end sections that form a rectangular border around the stock inlet opening 47. The second or downstream end wall 46 is generally rectangular and planar and includes a relatively small rectangular outlet opening.

The first frame end wall 44 extends generally perpendicular in one direction from the upstream end of the frame base wall 43. In the illustrated embodiment of FIGS. 1 and 2, this direction is upward. The second end wall 46 is preferably aluminum and extends in generally the same perpendicular direction from the downstream end of the frame base wall 43. In this manner, the housing 36 is basically "C" shape and one side of the frame base wall 43, which in this embodiment is the lower side, is a flat uninterrupted surface. The housing 36 also includes a box-like extension 49 removably attached to a downstream portion of the base wall 43. Although not shown in all of the drawings, the frame may be enclosed by a sheet metal housing, including side walls 37 and a top wall or cover 39.

The machine 20 further includes a stock supply assembly 50, a forming assembly 52, a feed assembly 54 powered by a feed motor 55, a cutting assembly 56 powered by a cutter motor 57, and a post cutting assembly 58. In operation of the machine 20, the stock supply assembly 50 supplies the stock material 22 to the forming assembly 52. The forming assembly 52 causes inward rolling of the lateral edges of the sheet-like stock material 22 to form the lateral pillow-like portions 33 of the continuous strip. The feed assembly 54 pulls the stock material 22 from the stock roll 21, through the stock supply assembly 50, and through the forming assembly 52 and also connects or stitches the central band of the strip to form the connected strip. As the connected strip travels downstream from the feed assembly 54, the cutting assembly 56 cuts the strip into sections 32 of a desired length. These cut sections 32 then travel through the post-cutting assembly 58.

Turning now to the details of the various assemblies, the stock supply assembly 50 includes two laterally spaced brackets 62. The brackets 62 are each generally shaped like a sideways "U" and have two legs 64 and 65 extending perpendicularly outward from a flat connecting base wall 66. (See FIGS. 1 and 2.) For each bracket 62, the base wall 66 is suitably secured to the downstream side of the frame end wall 44, such that the leg 64 is generally aligned with the frame base wall 43. Both of the legs 64 have open slots 70 in their distal end to cradle a supply rod 72. The supply rod 72 is designed to extend relatively loosely through the hollow tube 29 of the stock roll 21. As the stock material 22 is pulled through the machine 20 by feed assembly 54, the tube 29 will freely rotate thereby dispensing the stock material 22. A pin (not shown) may be provided through one or both ends of the supply rod 72 to limit or prevent rotation of the supply rod 72 itself.

The other legs 65 of the U-brackets 62 extend from an intermediate portion of the frame end wall 44 and cooperate to mount a sheet separator, indicated generally at 74. The sheet separator 74 includes three horizontally spaced relatively thin cylindrical separating bars 76, 77 and 78. The number of separating bars, namely three, corresponds to the number of paper layers or webs of the stock material 22. The sheet separator 74 separates the layers 24, 26 and 28 of paper prior to their passing to the forming assembly 52. This "pre-separation" is believed to improve the resiliency of the produced dunnage product. Details of a separating mechanism similar to the separator 74 are set forth in U.S. Pat. No. 4,750,896. (This patent is assigned to assignee of the present application and its entire disclosure is hereby incorporated by reference.)

The bracket legs 65 also cooperate to support a constant-entry bar 80 which is rotatably mounted on the distal ends of the legs. The bar 80 provides a non-varying point of entry for the stock material 22 into the separator 74 and forming assembly 52, regardless of the diameter of the stock roll 21. Thus, when a different diameter roll is used and/or as dispensation of the stock material 22 from roll 21 decreases its diameter, the point of entry of the stock material 22 into the separator 74 remains constant. This consistency facilitates the uniform production of cushioning dunnage. Details of a "roller member" or a "bar member" similar to the constant-entry bar 80 are set forth in U.S. Pat. No. 4,750,896.

After the stock material 22 is pulled from the stock roll 21 over the constant-entry bar 80 and through the sheet separator 74, it is pulled through the stock inlet opening 47 to the forming assembly 52. The forming assembly 52 includes a three-dimensional bar-like shaping member 90 (or forming frame), a converging chute 92, a transverse guide structure 93 and a guide tray 94. The stock material 22 travels between the shaping member 90 and the frame base wall 43 until it reaches the guide tray 94. At this point, the transverse guide structure 93 and the guide tray 94 guide the stock material 22 longitudinally and transversely into the converging chute 92. During this downstream travel, the shaping member 90 rolls the edges of the stock material 22 to form the lateral pillow-like portions 33 and the converging chute 92 coacts with the shaping member 90 to form the continuous strip. As the strip emerges from the converging chute 92, the guide tray 94 guides the strip into the feed assembly 54.

The shaping member 90 is a three-dimensional forming frame having a V-like, in plan body and generally U-shaped, in end elevation, ribs extending downwardly from and generally transverse to the body portion. Further structural details of the shaping member 90 or "forming frame" are set forth in U.S. Pat. No. 4,750,896.

The guide tray 94 is directly mounted on the frame base wall 43; while the transverse guide structure 93 and the converging chute 92 are mounted on the guide tray 94. The guide tray 94 is trapezoidal in shape, as viewed in plan, having a broad upstream side 105 and a parallel narrow downstream side 106. The broad side 105 is positioned downstream of at least a portion of the shaping member 90. The narrow side 106 is positioned adjacent the outlet opening in the frame end wall 46 and includes a rectangular slot 107 to accommodate the feed assembly 54. The guide tray 94 is not positioned parallel with the frame base wall 43, but rather slopes away (upwardly in FIGS. 1 and 2) from the frame base wall 43 to the feed assembly 54.

The converging chute 92 is mounted on the guide tray 94 upstream of at least a portion of the shaping member 90 and downstream slightly from the broad side 105 of the guide tray 94. The transverse guide structure 93 is mounted on the guide tray 94 just upstream of the entrance mouth of the converging chute 92. The transverse guide structure 93 includes rollers 108 rotatably mounted on a thin U-bracket 109. The distal ends of the U-bracket 109 are secured to the guide tray 94. Except for this mounting arrangement, the transverse guide structure 93 is similar to the "rollers and wire frame" disclosed in U.S. Pat. No. 4,750,896.

With the guide tray 94 and the transverse guide structure 93 mounted in this manner, the stock material 22 travels over the guide tray 94, under the upstream end of the shaping member 90, between the rollers 108 of the transverse guide structure 93, and into the converging chute 92. The basic cross-sectional geometry and functioning of the converging chute 92 is similar to that of the converging member described in U.S. Pat. No. 4,750,896.

Alternatively, the forming assembly 52 may include the chute and/or the shaping member disclosed in U.S. patent application Ser. No. 08/487,179. (This application is assigned to the assignee of the present application and its entire disclosure is hereby incorporated by reference.) Such a chute has an inlet end which is outwardly flared in a trumpeted fashion to facilitate passage of the stock material into the shaping chute. (The trumpet-like inlet may eliminate the need for the transverse guide structure 93.) Such a shaping member is longitudinally formed into a U-shape comprised of a first leg attached to a top wall of the chute and a second leg extending into the chute generally parallel with the bottom wall of the chute.

The stock material 22 will emerge from the chute 92 as the continuous unconnected strip. The emerging strip is guided to the feed assembly 54 by the narrow downstream end 106 of the guide tray 94, which extends from the outlet opening of the chute to the outlet opening in the frame end wall 46. The feed assembly 54 includes rotating feed members between which the stock material 22 travels, specifically loosely meshed horizontally arranged drive gear 124 and idler gear 126. When the gears 124 and 126 are turned the appropriate direction, which in FIG. 1 would be counter-clockwise for gear 124 and clockwise for gear 126, the central band of the strip is grabbed by the gear teeth and pulled downstream through the nip of gears 124 and 126. This same "grabbing" motion caused by the meshing teeth on the opposed gears 124 and 126 simultaneously compresses or "coins" the layers of the central band together thereby connecting the same and forming the connected strip.

The drive gear 124 is positioned between the frame base wall 43 and the guide tray 94 and projects through the rectangular slot 107 in the guide tray 94. The gear 124 is fixedly mounted to a shaft 130 which is rotatably mounted to the upstream side of the frame end wall 46 by bearing structures 131. A sprocket 132 at one end of the shaft accommodates a chain 133 which connects the shaft 130 to a speed reducer 136. The speed reducer 136 acts as an interface between the feed assembly 54 and the feed motor 55 for controlling the rate of "pulling" of the stock material 22 through the machine 20. As is best seen in FIG. 1, the feed motor 55 and the speed reducer 136 are mounted on the frame base wall 43 at approximately the same level as the forming assembly 52.

The idler gear 126 is positioned on the opposite side of the guide tray 94 and is rotatably mounted on a shaft 140. Shaft brackets 142 attached to an upstream side of the frame end wall 46 non-rotatably support the ends of the shaft 140 in spring-loaded slots 144. The slots 144 allow the shaft 140, and therefore the idler gear 126, to "float" relative to the drive gear 124 thereby creating an automatic adjustment system for the feed assembly 54.

Alternatively, the automatic adjustment system for feed assembly 54 could be of the type disclosed in U.S. patent application Ser. No. 08/487,179. In such an adjustment system, first and second tie members would be movably connected to the shaft 140 and would extend transversely with respect to the shaft 140. Each of the tie members would have one end in fixed transverse position relative to the machine's housing 36 and an adjustable stop which is selectively adjustable towards and away from the shaft 140. A spring member would be interposed between the shaft 140 and the adjustable stop to resiliently bias the shaft 140 towards the shaft 130. In this manner, the pinch force applied by the rotating feed members 124 and 126 could be adjusted without changing a minimum set distance between the shafts 130 and 140.

Additionally or alternatively, the rotating feed members 124 and 126 may be of the type contained in the stitching assembly disclosed in U.S. patent application Ser. No. 08/607,607. (This application is assigned to the assignee of the present application and its entire disclosure is hereby incorporated by reference.) In such a stitching assembly, the first rotating feed member would have a plurality of radially outwardly extending projections around its circumference and the projections would have at axially spaced apart segments defining a recess therebetween. The second rotating feed member would have axial punch segments which each include a peripheral edge portion for receipt into the first member's recesses. The peripheral edge portions would have opposite corners which are cooperative with the first member's projections to cut a row of slits in the overlapped portions of the stock material to interlocking these overlapped portions.

In any event, the feed assembly 54 transforms the unconnected strip into the connected strip and this strip travels through the outlet opening in the frame end wall 46. The connected strip is then cut by the cutting assembly 56 into cut sections 32 of the desired length. The cutting assembly 56 may be of any suitable type, such as the types disclosed in U.S. Pat. No. 5,123,899, the type disclosed in U.S. patent application Ser. No. 08/110,349, and/or the type disclosed in U.S. patent application Ser. No. 08/188,305. (This patent and these applications are assigned to the assignee of the present invention and their entire disclosures are hereby incorporated by reference.) However, whatever type of cutting or severing assembly is used, the connected strip is divided into cut sections 32 of the desired length and these cut sections 32 then travel downstream to the post cutting assembly 58.

The post-cutting assembly 58 is basically funnel-shaped and includes an upstream converging portion 300 which tapers into a downstream rectangular tunnel portion 302. The converging portion 300 is located between the downstream frame end wall 46 and the extension 49, while the tunnel portion 302 extends through and beyond the frame extension 49. The post-cutting assembly 58 is positioned so that its inlet 304 is aligned with the outlet opening of the end wall 46. The downstream outlet 306 of the post-cutting assembly 58 is also preferably aligned with the outlet opening and also the inlet 304.

A cut section 32 will be urged or pushed downstream into the inlet 304 of assembly 58 by the approaching connected strip. The converging portion 300 smoothly urges the section 32 into the tunnel portion 302. A cut section 32 emerging from the post-cutting assembly 58 may be directed to a desired packing location, the conversion of stock material 22 to cut sections 32 of relatively low density pad-like cushioning dunnage product now being complete.

Turning now to FIGS. 4–7, the pad adjustment device 400 is shown in detail. The device 400 includes a pair of rollers 404 movably mounted to the machine housing 36 by a mounting assembly 406. The mounting assembly 406 positions the rollers 404 between the output of the forming chute 92 and the feed gears 124/126. Thus, the device 400 may be viewed as forming an extension of the forming chute 92.

The device 400 allows selective adjustment of the spacing or distance D between the rollers 404. (Compare FIGS. 5, 6 and 7.) If the distance D between the rollers 404 is greater than the width of the exit end of the converging chute 92, the rollers 404 will have little or no contact with (and/or little or no effect on) the strip as it passes therebetween. (See FIG. 5.) Thus, the width of the pad will be same as if the machine 20 did not include the device 400. If the distance D between the rollers 404 is decreased to less than the width of the exit end of the converging chute, the rollers 404 compress the strip into a narrower form, thereby resulting in a narrower pad. (See FIG. 6.) If the distance D between the rollers is decreased even more, an even narrower pad will be produced. (See FIG. 7.)

The rollers 404 preferably have a concave spool shape with an axial dimension approximately equal to the height of the exit of the converging chute 92. (See FIG. 4.) Additionally, the rollers 404 are positioned so that their lower axial ends are adjacent the guide tray 94. In this manner, the concave surfaces of the rollers 404 will surround the lateral edges of the strip as it emerges from the converging chute 92. The mounting assembly 406 preferably rotatably supports the rollers 404 whereby they will freely turn as the strip passes therethrough.

The preferred mounting assembly 406 includes a pair of arms 408, and an adjustment bar 410. The arms 408 each have one end pivotally mounted to the end plate 46 via a pivotal coupling element 412. When the arms 408 are pivoted away from each other, pad width will be increased (or maximized) (see FIG. 5) and when the arms 408 are pivoted towards each other, pad width will be decreased (see FIGS. 6 and 7). In this manner, slight variations in pad widths may be easily accomplished for use with, for example, sophisticated packaging systems.

The arms 408 each have an opposite end having a slot 414 which slidably receives a leg of an L-shaped cross bar 416. The cross-bar 416 is suspended between the frame side panels 37 and stabilizes the arms 408 by preventing them from moving up and down while still allowing the arms 408 to pivot relative to the machine's housing 36.

The adjustment bar 410 extends between distal portions of the arms 408 and may be used to the determine or set the spacing between the rollers 404. The adjustment bar 410 is fixedly secured to one arm 408 (the one positioned in the upper portions of FIGS. 5–7) via a fixed bracket 417 and slidably secured to the other arm 408 via a sliding bracket 418. Thus to adjust the spacing between the rollers 404 (and thus the pad width), the adjustment bar 410 is moved in a direction perpendicular to the upstream-downstream direction. Other means for adjusting the spacing between the rollers is possible with, and contemplated by, the present invention. For example, a threaded rod could be provided between the arms 408 for screwing/unscrewing to decrease/increase pad width.

The sliding bracket 418 includes a knob-locking screw 420 for receipt into appropriately positioned apertures 422 in the bar 410. Although not specifically shown on the drawings, the apertures 422 define "locking positions" corresponding to predetermined pad widths, preferably in 1 inch intervals. (Note that the apertures 422 themselves will not necessarily be spaced at exactly these intervals, as the relevant parameter is the spacing of the rollers 404.) Although also not specifically shown in the drawings, the adjustment bar 410 may include indicia identifying the aperture settings, and particularly the pad widths corresponding to the aperture settings.

Another device 500 for selectively adjusting the cross-sectional geometry of a cushioning pad according to the present invention is shown in FIGS. 8–11. The device 500 may be incorporated into the cushioning conversion machine 20, or any other cushioning conversion machine or method which falls within the scope of the claims.

The device 500 includes a pair of rollers 504 movably mounted to the machine housing 36 by a mounting assembly 506. The mounting assembly 506 positions the rollers 504 between the output of the forming chute 92 and the feed gears 124/126. Thus, the device 500 may be viewed as forming an extension of the forming chute 92.

The device 500 allows selective adjustment of the spacing or distance D between the rollers 504. (Compare FIGS. 9, 10 and 11.) If the distance D between the rollers 504 is greater than the width of the exit end of the converging chute 92, the rollers 504 will have little or no contact with (and/or little or no effect on) the strip as it passes therebetween. (See FIG. 9.) Thus, the width of the pad will be same as if the machine 20 did not include the device 500. If the distance D between the rollers 504 is decreased to less than the width of the exit end of the converging chute, the rollers 504 compress the strip into a narrower form, thereby resulting in a narrower pad. (See FIG. 10.) If the distance D between the rollers is decreased even more, an even narrower pad will be produced. (See FIG. 11.)

The rollers 504 preferably have a concave spool shape with an axial dimension approximately equal to the height of the exit of the converging chute 92. (See FIG. 8.) Additionally, the rollers 504 are positioned so that their lower axial ends are adjacent the guide tray 94. In this manner, the concave surfaces of the rollers 504 will surround the lateral edges of the strip as it emerges from the converging chute 92. The mounting assembly 506 preferably rotatably supports the rollers 504 whereby they will freely turn as the strip passes therethrough.

The preferred mounting assembly 506 includes a first pair of arms 508, a second pair of arms 509, an adjustment bar 510, and a slidably mount 511 for the adjustment bar 510. The arms 508 each have one end pivotally mounted to the end plate 46 via a pivotal coupling element 512. When the arms 508 are pivoted away from each other, pad width will be increased (or maximized) (see FIG. 9) and when the arms 508 are pivoted towards each other, pad width will be decreased (see FIGS. 10 and 11). In this manner, slight variations in pad widths may be easily accomplished for use with, for example, sophisticated packaging systems.

The arms 508 each have an opposite end having a slot 514 which slidably receives a leg of an L-shaped cross bar 516. The cross-bar 516 is suspended between the frame side panels 37 and stabilizes the arms 508 by preventing them from moving up and down while still allowing the arms 508 to pivot relative to the machine's housing 36.

The second pair of arms 509 are each pivotally connected at one end to a distal portion of respective arms 508. (See FIGS. 8–11.) The opposite ends of the second pair of arms is pivotally connected to one end of the adjustment bar 510. Thus, the arms 508 and 509 form a four-arm linkage, the movement of which is controlled by the adjustment bar 510 to thereby determine or set the spacing between the rollers 504.

As was indicated above, one end of the adjustment bar 510 is connected to corresponding ends of the arms 509. The opposite end of the adjustment bar 510 is slidably mounted on the mount 511. To adjust the spacing between the rollers 504 (and thus the pad width), the adjustment bar 510 is moved in a direction parallel to the upstream-downstream direction. The mount 511 may be coupled to the machine's frame via, for instance, a hanger 517, suspended from a cross-bar 518 extending between the machine's side panels 37.

The adjustment bar 510 preferably includes a knob-locking screw 520 for receipt into appropriately positioned apertures 522 in the mount 511, The apertures 522 define "locking positions" corresponding to predetermined pad widths, preferably in one inch intervals. (Note that the apertures 522 themselves will not necessarily be spaced at exactly these intervals, as the relevant parameter is the spacing of the rollers 504.) The mount 511 also may include indicia identifying the aperture settings, and particularly the pad widths corresponding to the aperture settings.

Another device 600 for selectively adjusting the cross-sectional geometry of a cushioning pad produced by a cushioning conversion machine according to the present invention is shown in FIGS. 12–15. The device 600 may be incorporated into the cushioning conversion machine 20, or any other cushioning conversion machine or method which falls within the scope of the claims.

The device 600 includes a pair of rollers 604 movably mounted to the machine housing 36 by a mounting assembly 606. The mounting assembly 606 positions the rollers 604 between the output of the forming chute 92 and the feed gears 124/126. Thus, the device 600 may be viewed as forming an extension of the forming chute 92 and/or a second forming assembly.

The device 600 allows selective adjustment of the spacing or distance D between the rollers 604. (Compare FIGS. 13, 14 and 15.) If the distance D between the rollers 604 is greater than the width of the exit end of the converging chute 92, the rollers 604 will have little or no contact with (and/or little or no effect on) the strip as it passes therebetween. (See FIG. 13.) Thus, the width of the pad will be same as if the machine 20 did not include the device 600. If the distance D between the rollers 604 is decreased to less than the width of the exit end of the converging chute, the rollers 604 compress the strip into a narrower form, thereby resulting in a narrower pad. (See FIG. 14.) If the distance D between the rollers is decreased even more, an even narrower pad will be produced. (See FIG. 15.)

The rollers 604 preferably have a concave spool shape with an axial dimension approximately equal to the height of the exit of the converging chute 92. (See FIG. 12.) Additionally, the rollers 604 are positioned so that their lower axial ends are adjacent the guide tray 94. In this manner, the concave surfaces of the rollers 604 will surround the lateral edges of the strip as it emerges from the converging chute 92. The mounting assembly 606 preferably rotatably supports the rollers 604 whereby they will freely turn as the strip passes therethrough.

The preferred mounting assembly 606 includes a first pair of arms 608, a second pair of arms 609, an adjustment bar 610, and a mount 611 for the adjustment bar 610. The arms 608 each have one end pivotally mounted to the end wall 46 via a pivotal coupling element 612. When the arms 608 are pivoted away from each other, pad width will be increased (or maximized) (see FIG. 13) and when the arms 608 are pivoted towards each other, pad width will be decreased (see FIGS. 14 and 15). In this manner, slight variations in pad widths may be easily accomplished for use with, for example, sophisticated packaging systems.

The second pair of arms 609 are each pivotally connected at one end to a distal portion of respective arms 608. (See FIGS. 12–16.) The opposite ends of the second pair of arms is pivotally connected to one end of the adjustment bar 610. A spacer 614 is provided so that the arms 609 may be stacked one on top of the other. Thus, the arms 608 and 609 form a four-arm linkage, the movement of which is controlled by the adjustment bar 610 to thereby determine or set the spacing between the rollers 604. Also, the rollers 604 are simultaneously moved uniform distances to insure proper placement relative to the exit of the chute 92 and/or the feed gears 124/126.

As was indicated above, one end of the adjustment bar 610 is connected to corresponding ends of the arms 609. The opposite end of the adjustment bar 610 is slidably mounted on the mount 611. In the illustrated orientation, the adjustment bar 610 is vertically positioned so that its lower end is connected to the arms 609 and its upper end is slidably received in the mount 611. Specifically, the slidable mount 611 is attached to the inner side of the machine's top wall 39 and includes a slot through which a knob 620 extends. The knob 620 is connected to the top end of the bar 610. To adjust the spacing between the rollers 604 (and thus the pad width), the knob 620 (and thus the adjustment bar 610) is moved in a direction parallel to the upstream-downstream direction. The top cover 39 may include indicia identifying settings for the knob 620 which correspond to particular pad widths. Thus, the device 600 includes a control element which is situated outside the housing of the cushioning conversion machine whereby the machine housing need not be opened to vary the cross-sectional geometry, or width, of the cushioning pad.

Another device 700 for selectively adjusting the cross-sectional geometry of a cushioning pad produced by a cushioning conversion machine is shown in FIGS. 16–19.

The device 600 may be incorporated into the cushioning conversion machine 20, the cushioning conversion machine disclosed in U.S. Pat. No. 4,968,291, and/or any cushioning conversion machine or method which falls within the scope of the claims.

The device 700 includes a pair of guide members 704 mounted to the machine frame 36 by a mounting assembly 706. The mounting assembly 706 positions the guide members 704 between the output of the forming chute 92 and the feed gears 124/126. Thus, the device 700 is positioned to guide the stock material as it travels between the forming assembly 52 and the feed assembly 54.

The guide members 704 preferably have a smooth cylindrical shape with an axial dimension approximately equal to the height of the exit of the converging chute 92. (See FIG. 16.) Additionally, the guide members 704 are positioned so that their lower axial ends are adjacent the guide tray 94. In this manner, the cylindrical surfaces of the guide members 704 will guide the lateral edges of the strip as it emerges from the converging chute 92.

The guide members 704 have an axially extending core 705 through which components of the mounting assembly 706 extend to non-rotatably support the guide members 704. The cores 705 are eccentrically (i.e., non centrally located) on each of the guide members 704. In this manner, the device 700 is designed to allow selective adjustment of the spacing or distance between the guide members 704. (Compare FIGS. 17, 18 and 19.) When the guide members 704 are positioned so that the distance between the outer circumference of the guide members 704 is a distance approximately equal to the width of the exit end of the converging chute 92, the guide members 704 will guide the strip as in a non-converging path as it passes therebetween. (See FIG. 17.) Thus, the width of the pad will be same as if the machine 20 did not include the device 700. When the guide members are positioned so that the distance between the outer circumference of the guide members 704 is decreased to less than the width of the exit end of the converging chute 92, the guide members 704 guide the strip and compress it into a narrower form, thereby resulting in a narrower pad. (See FIG. 18.) When the guide members 704 are positioned so that the distance between the outer circumference of the guide members 704 is at a minimum distance, the guide members 704 guide the strip and compress it into an even narrower form. (See FIG. 19.)

The preferred mounting assembly 706 includes is bar-shape member having a goal post, or U-shape geometry. Thus, the preferred mounting assembly 706 includes a bottom member 708, and two vertically extending posts 709. The bottom member 708 is preferably positioned below the mounting tray 94 and attached thereto by a mounting bracket 710. The vertical posts 709 extend through openings in the mounting tray 92 and the guide members 704 are non-rotatably mounted thereon. The mounting assembly 706 preferably includes locating structure to lock the guide members 704 in the selected position. For example, the top ends of the vertical posts 709 may be threaded whereby a locking member 711 may be used to lock the guide member in the desired positioning relative to the vertical posts 709.

Figure 20:
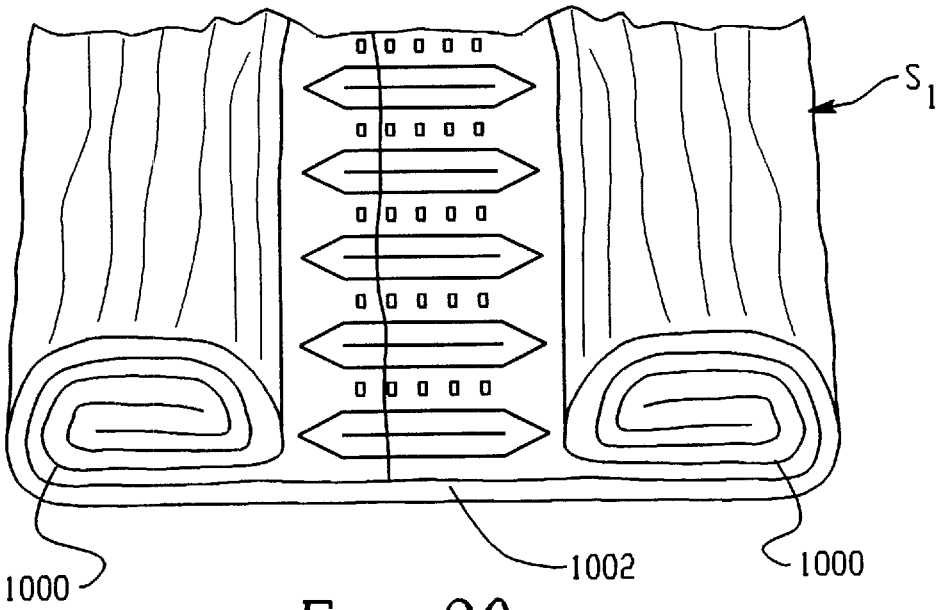
FIG. 20 is a perspective view of a cushioning product or pad made when any of the adjustment devices 400, 500, 600 or 700 are positioned so that the cushioning conversion machine 20 will produce a maximum width pad.
Figure 21:
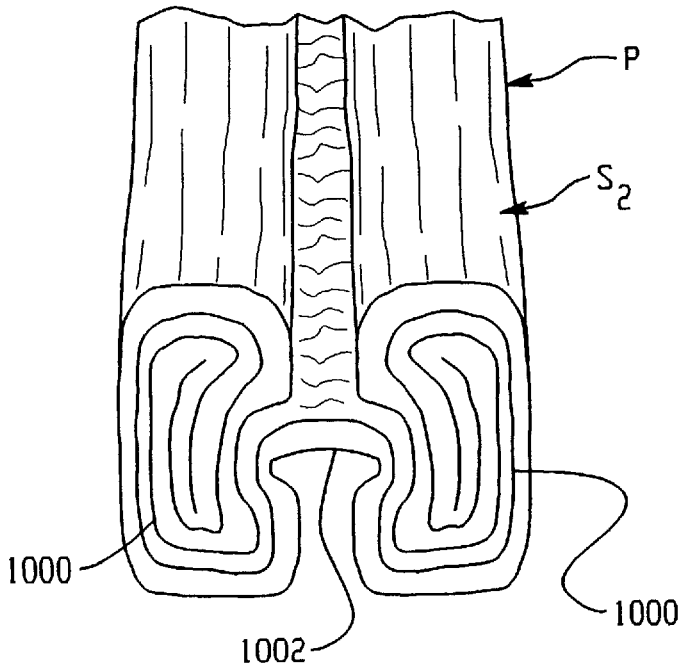
FIG. 21 is a perspective view of a cushioning product or pad made when any of the adjustment devices 400, 500, 600 or 700 are positioned so that the cushioning conversion machine 20 will produce a narrow pad.

When the device 400, 500, 600 or 700 is one of the narrower-width settings, the machine 20 essentially performs a two-step forming process on the stock material. Specifically, the sheet-like stock material is formed into a first strip $S_1$ of a certain width by inwardly turning the lateral edges of the sheet-like stock material in the forming assembly 52. (FIG. 20.) The strip $S_1$ includes two lateral pillow-like sections 1000 and a central connecting section 1002. This first strip $S_1$ is then formed into another strip $S_2$ of a less width by inwardly compressing the outer lateral sides of the first strip $S_1$ by the device 700. (FIG. 21.) The resulting cushioning product P comprises two lateral pillow-like portions 1000, each including inwardly turned lateral edges of the sheet-like stock material which have once again been inwardly compressed. (FIG. 21.)

Figure 22:
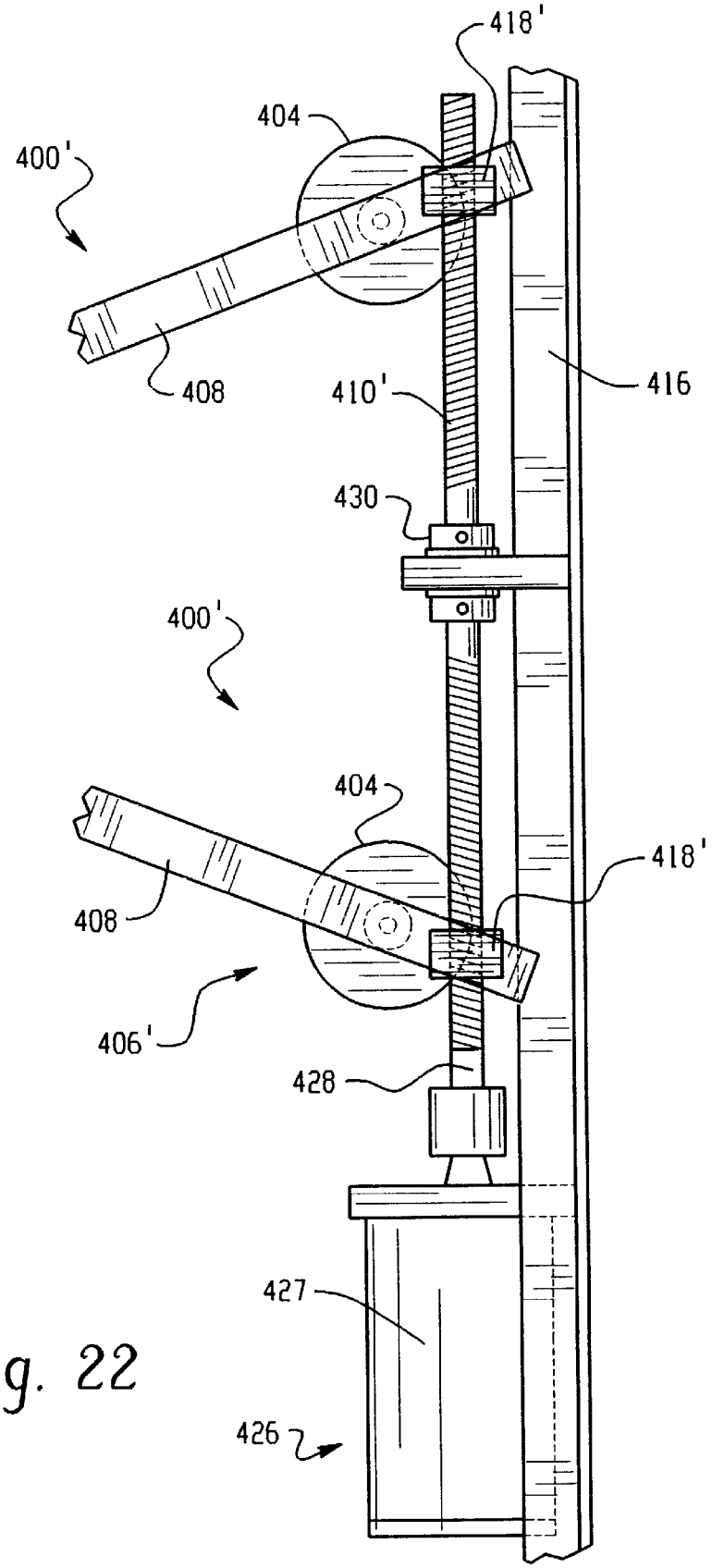
FIG. 22 is a schematic top view of a modified adjustment device 400', the device including a motorized drive.

A modified version 400' of the device 400 is shown in FIG. 22. (The same reference numerals are used to designate identical components, "primed" reference numerals are used to designate analogous, but modified, components, and new reference numerals are used to designate new components.). The device 400' includes a motorized drive 426 for adjusting the spacing between the rollers 404 (and thus the pad width) by rotating the adjustment bar 410'. The motorized drive 426 is preferably a reversible electrical motor 427 having a shaft 428 coupled to a threaded adjustment rod 410' of the modified mounting assembly 406'. The rod 410' has external left-hand screw treads on one side and external right-hand screw treads on the other side. Brackets 418' (attached to the arms 408) have corresponding internal screw treads. The brackets 418' include diagonal slots to allow the arms 408 to be moved inwardly and outwardly without movement of the rod 410'.

The motorized drive 426 may be manually activated (i.e., a push button is held down for a particular period of time). When the motor shaft 428 (and thus the adjustment rod 410') is rotated in one direction, the brackets 418' (and thus the arms 408 and the rollers 404) are moved inwardly. When the motor shaft 428 is rotated in the opposite direction, the brackets 418 are moved outwardly. If desired, the adjustment rod 410' may be mounted to the cross-bar 416 by a bearing structure 430.

Figure 23:
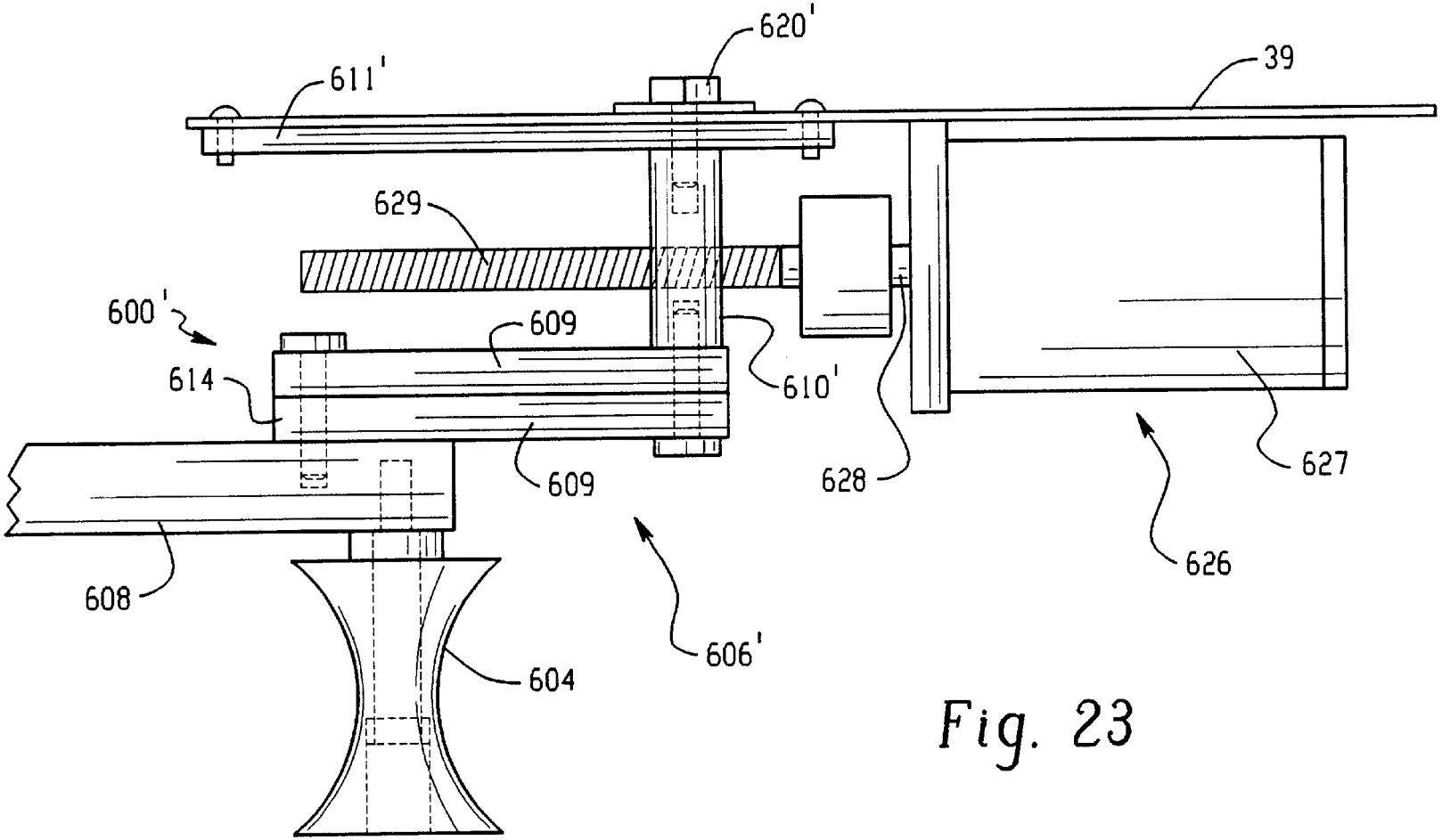
FIG. 23 is schematic side view of a modified adjustment device 600', the device including a motorized drive.

A modified version 600' of the device 600' is shown in FIG. 23. (The same reference numerals are used to designate identical components, "primed" reference numerals are used to designate analogous, but modified, components, and new reference numerals are used to designate new components.) The device 600' includes a motorized drive 626 for adjusting the spacing between the rollers 604 (and thus the pad width) by moving the adjustment bar 610' in a direction parallel to the upstream-downstream direction. The motorized drive 626 is preferably a reversible electric motor 627 having a shaft 628 coupled to a feed screw 629. The adjustment bar 610' includes a threaded opening which receives the feed screw 629.

The motorized drive 626 may be manually activated (i.e., a push button is held 5 down for a particular period of time). When the motor shaft 628 (and thus the feed screw 629) is rotated in one direction, the adjustment bar 610' is moved downstream and the arms 609 (and thus the arms 608 and the rollers 604) are moved inwardly. When the motor shaft 628 is rotated in the opposite direction, the adjustment bar 610' is moved upstream and the rollers 604 are moved outwardly.

As was indicated above, the motorized drive 426 and/or 626 may be manually activated. Alternatively, to automatically control the motorized drives 426, 626, or any other motorized drive which moves a pad width adjustment device, the cushioning conversion machine 20 may include one or more of the control systems shown in FIGS. 24A–24F.

Figure 24A:
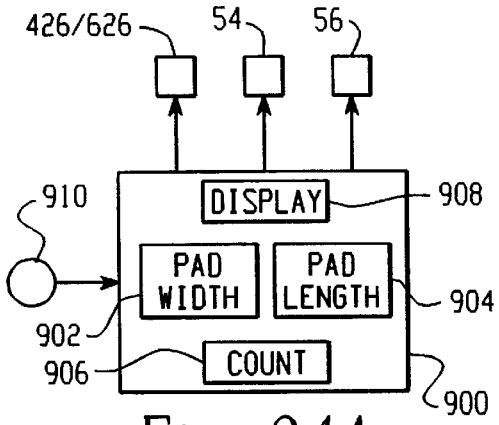
FIGS. 24A–24F are schematic views of various control systems according to the present invention for controlling a cushioning conversion machine including an adjustment device with a motorized drive.

In the control system shown in FIG. 24A, the machine's internal controller 900 (i.e. a microprocessor) is operably coupled to the motorized drive 426/626, the feed assembly 54, and the cutting assembly 56. The controller 900 includes an input 902 for the pad width, an input 904 for the pad length, an input 906 for the number of pads needed (i.e., count) and a display 908 for displaying the inputted width and/or length. A feedback 910 is provided for determining the current position of the rollers 404/604 and to report the same to the internal controller 900. Based on the pad width input, the pad length input, the count input, and the feedback, the controller 900 controls the motorized drive 426/626, the feed assembly 54, and the cutting assembly 56.

Figure 24B:
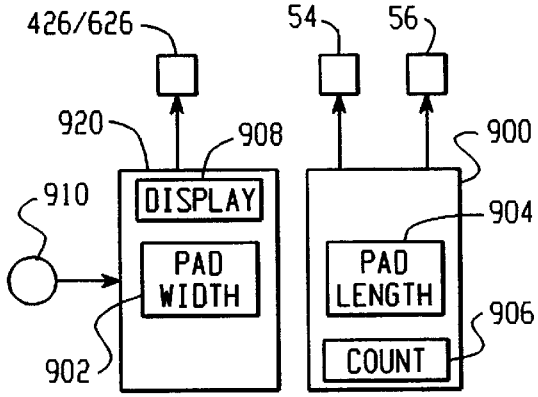

In the control system shown in FIG. 24B, the machine's internal controller 900 is operably coupled to the feed assembly 54 and the cutting assembly 56, but not the motorized drive 426/626, and the internal controller 900 includes the input 904 for pad length and the input 906 for pad count. An external controller 920 is operably coupled to the motorized drive 426/626 and the feedback 910 reports to the external controller 920. The external controller 920 includes the input 902 for pad width and the display 908. Based on the pad width input and feedback information, the external controller 920 controls the motorized drive 426/626. Based on the pad length input and count input, the internal controller 900 controls the feed assembly 54 and the cutting assembly 56.

Figure 24C:
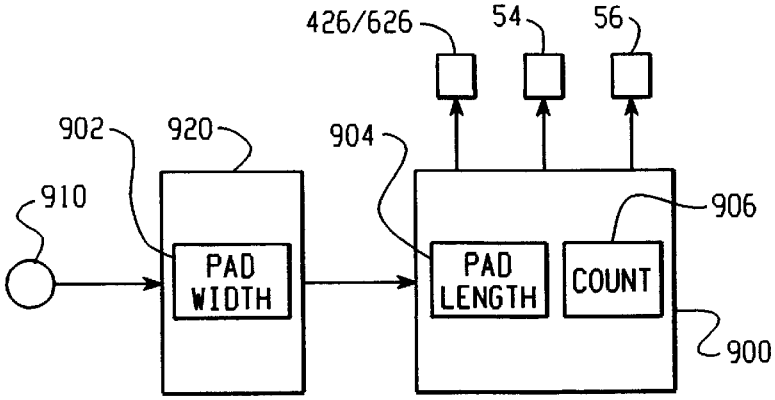

In the control system shown in FIG. 24C, the internal controller 900 is operably coupled to the motorized drive 426/626, the feed assembly 54, and the cutting assembly 56. The internal controller 900 includes the input 904 for pad length and the input 906 for pad count. An external controller 920 includes the input 902 for pad width and receives the report from feedback 910. The external controller 920 conveys the pad width input and feedback information to the internal controller 900 which in turn controls the motorized drive 426/626, the feed assembly 54, and the cutting assembly 56.

Figure 24D:
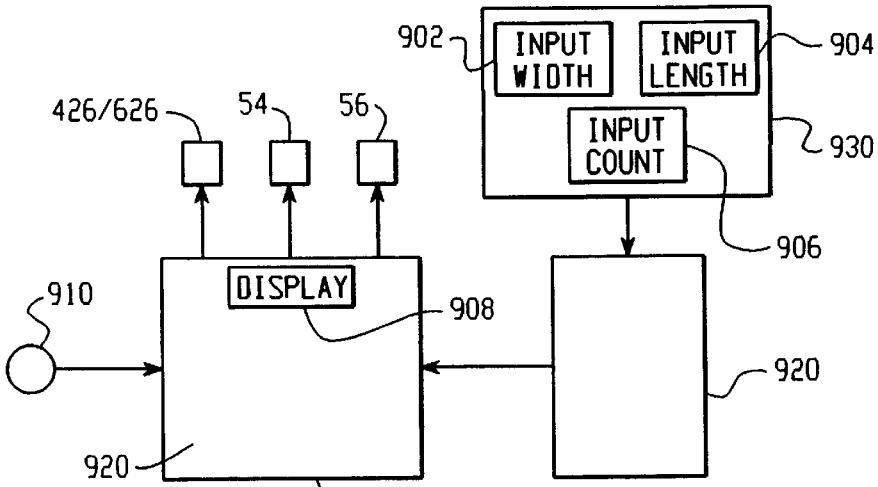

In the control system shown in FIG. 24D, the internal controller 900 is operably coupled to the motorize drive 426/626, the feed assembly 54, and the cutting assembly 56. An operator interface/monitor 930 includes the input 902 for pad width, the input 904 for pad length, and the input 906 for pad count. This input information is conveyed to the external controller 920 which in turn conveys the information to the internal controller 900 for control of the motorized drive 426/626, the feed assembly 54, and the cutting assembly 56.

Figure 24E:
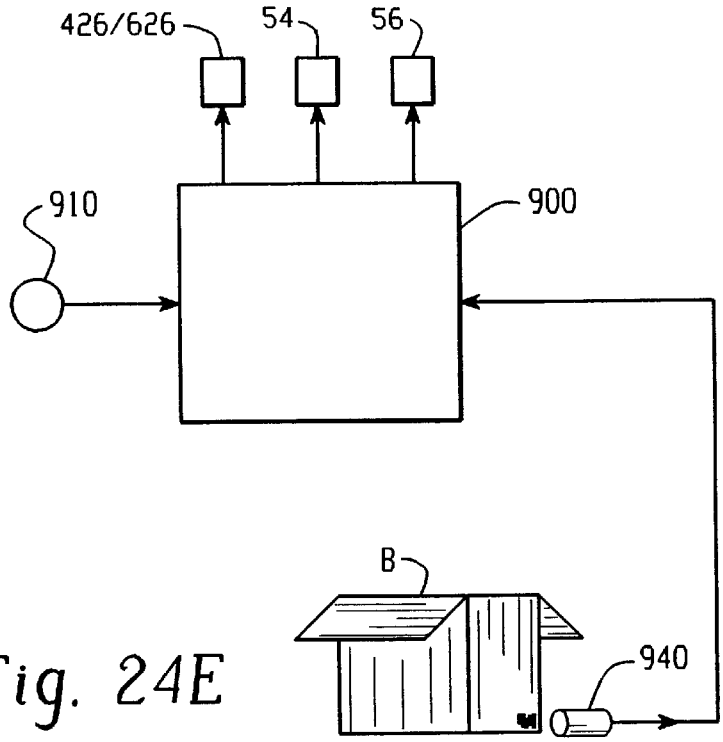

In the control system shown in FIG. 24E, the internal controller 900 is operably coupled to the motorized drive 426/626, the feed assembly 54, and the cutting assembly 56. The feedback 910 reports to the internal controller 900. A determining device 940, such as for example a bar code scanner, is provided to determine the packaging needs of a box B. The determining device 940 conveys this information to the controller 900 whereby the controller 900 controls the motorized drive 426/626, the feed assembly 54, and the cutting assembly 56 in accordance with this information and the feedback.

Figure 24F:
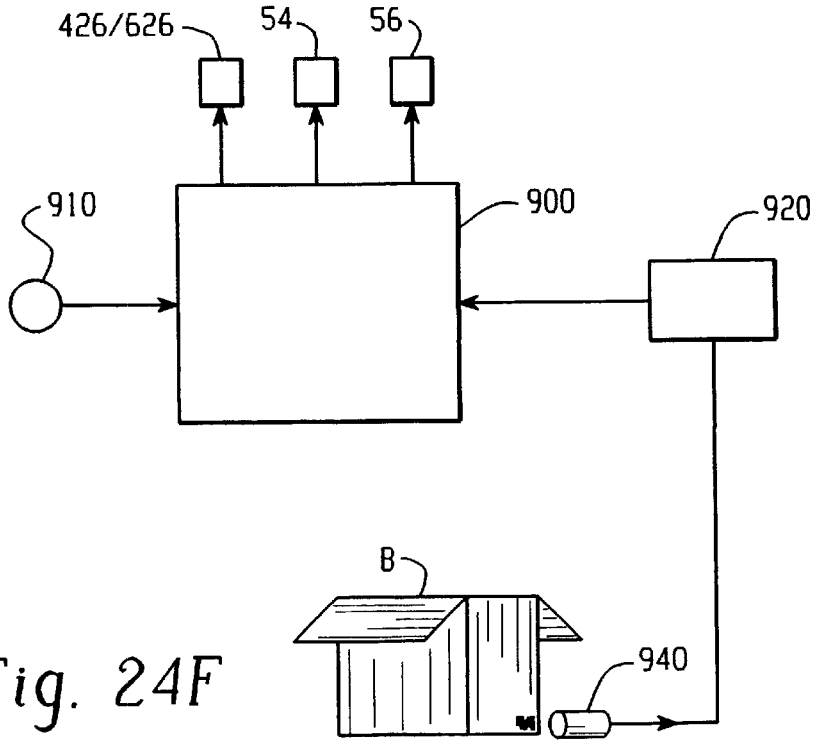

In the control system shown in FIG. 24F, the internal controller 900 is operably coupled to the motorized drive 426/626, the feed assembly 54, and the cutting assembly 56. The feedback 910 reports to the internal controller 900. The determining device 940 conveys the information to an external controller 920 which in turn conveys the information to the internal controller 900. The controller 900 controls the motorized drive 426/626, the feed assembly 54, and the cutting assembly 56 in accordance with this information and the feedback.

In the control systems shown in FIGS. 24A–24F, the feedback 906 is used as a "base line" for determining the degree and direction of rotation the adjustment bar 410'/610' to move the rollers 404/604 to a position corresponding to the inputted pad width. The feedback 906 could be, for example, limit switches which sense the position of certain moving components (i.e, the brackets 418', the rollers 404/604, etc.), sensors which sense the angle of the arms 408/608, an encoder positioned to monitor the incremental rotation of the rotating members (adjustment bar 410' and feed screw 629), an analog potential meter, linear scales, an absolute position sensor, proximity switch target, or any other suitable feedback.

Thus, based on the current position of the pad adjustment device 400'/600' as determined by the feedback 906, the controller 900 or 920 controls the device to move it to the desired inputted position. The degree and direction of this movement may be determined by calculating the number and direction of turns necessary, activating the motorized drive 426/626, monitoring (such as with an encoder) the number of turns, and the deactivating the motorized drive once the calculated number of rotations has been made. Alternatively, if switches are appropriately positioned (corresponding to, for example, ½" pad width intervals), the motorized drive could be activated until it reaches the appropriate switch. Instead of using a feedback 906, the pad adjustment device 400'/600' could be returned to a certain position prior to each adjustment.

One may appreciate that a cushioning conversion machines which incorporates the device 400' or the device 600' can accommodate more sophisticated packaging needs without the need for manual adjustments. For example, suppose a box B requires a first pad having a length $L_1$ and a width $W_1$, a second pad having a length $L_2$ and a width $W_2$, and a third pad having a length $L_3$ and a width $W_3$. If one of the control systems shown in FIGS. 24A–24D was being used, the operator would input a pad length of $L_1$ a pad width of $W_1$, and a count of one. Based on the current position of the rollers 404/604 as sensed by the feedback device 910, either the controller 900 or the controller 920 would activate the motor 427/627 to rotate the adjustment bar 410'/610' in the appropriate direction to move the rollers 404/604 to a position corresponding to a pad width of $W_1$. The controller 900 would then activate the feed assembly 54 to produce dunnage strip which has a length of $L_1$, deactivate the feed assembly, and then activate the cutting assembly 56 to cut the strip into a pad which has a length of $L_1$ and a width of $W_1$. The operator would then input a pad length of $L_2$ and a pad width of $W_2$ and the process would be repeated to produce a pad which has a length of $L_2$ and a width of $W_2$. The operator would then input a pad length of $L_3$ and a pad width of $W_3$ and the process would be repeated to produce a pad which has a length of $L_3$ and a width of $W_3$.

If either of the control systems shown in FIGS. 24E or 24F was being used, inputs by the operator would not be necessary and the controller 900 would (based on the information from the determining device 940) adjust the device 400'/600' and control the conversion assemblies to produce a first pad having a length of $L_1$ and a width of $W_1$, a second pad having a length of $L_2$ and a width of $W_2$, and a third pad having a length of $L_3$ and a width of $W_3$.

Figure 25:
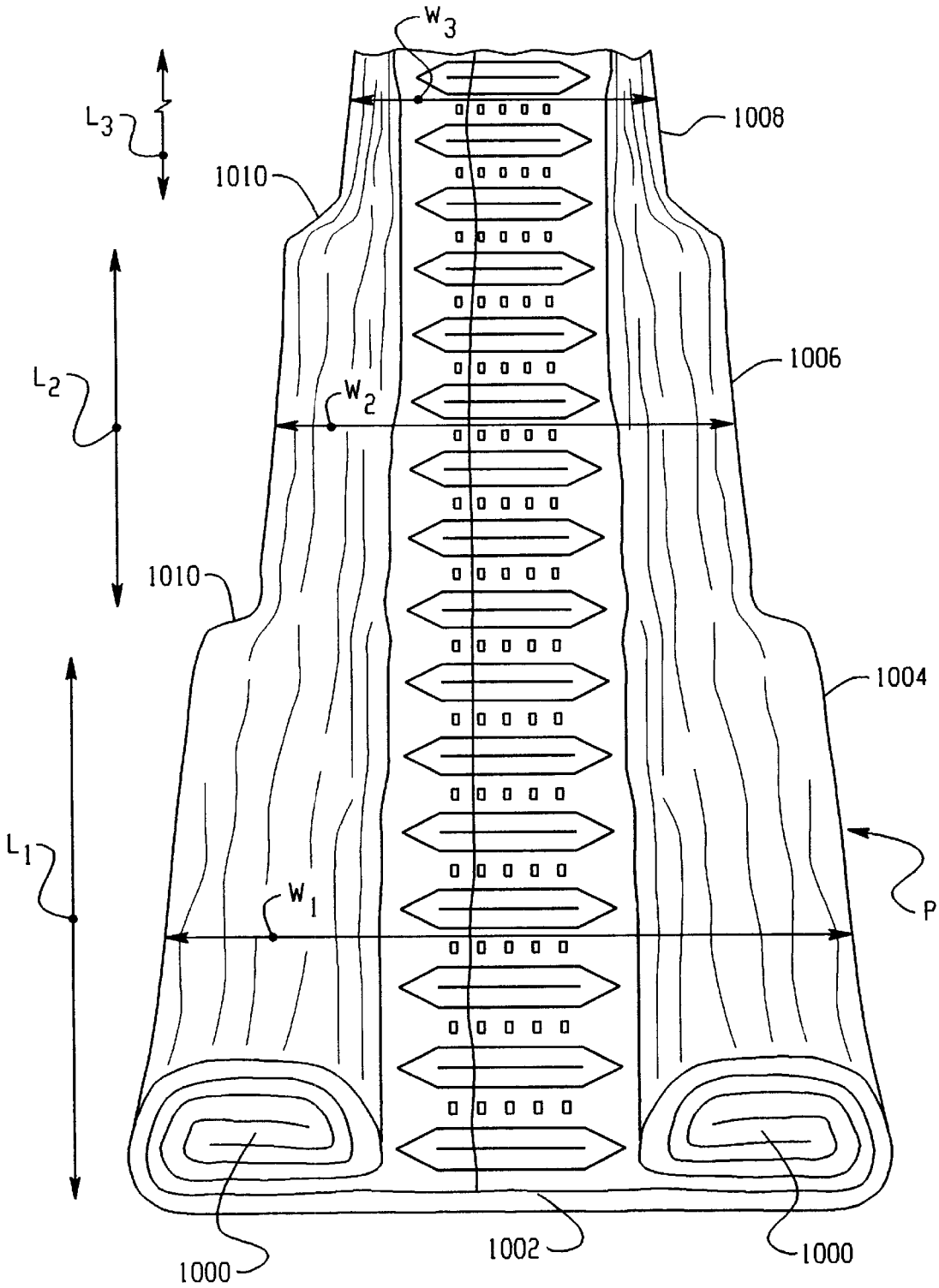
FIG. 25 is a perspective view of a cushioning product or pad according to the present invention.

Alternatively, a cushioning conversion machine which incorporates the device 400' or the device 600' can be used to produce a pad having tapering and/or varying widths, such as the pad P shown in FIG. 25. The pad P includes two lateral pillow-like sections 1000 and a central connecting section 1002. The pad P includes a first portion 1004 having a length $L_1$ and a width $W_1$, a second portion 1006 having a length $L_2$ and a width $W_2$ and a third portion 1008 having a length $L_3$ and a width $W_3$. The pad P may also include short transition portions 1010 between the portions 1004 and 1006 and the portions 1006 and 1008. In the illustrated pad P, the widths $W_1$, $W_2$, $W_3$ progressively decrease whereby the pad P has a tapering geometry.

Figure 26:
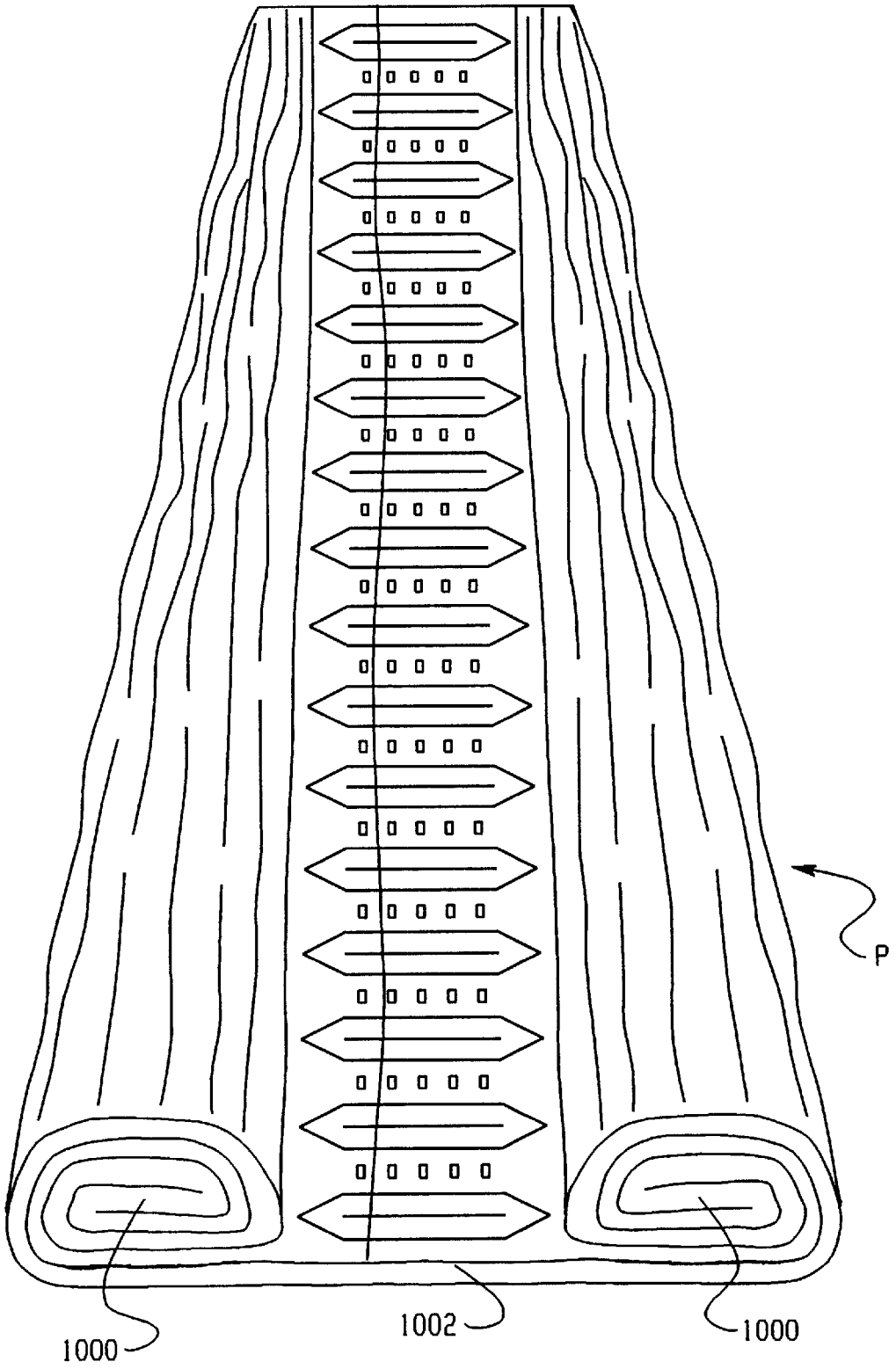
FIG. 26 is a perspective view of another cushioning product or pad according to the present invention.

However, other arrangements of pad portions are possible with, and contemplated by, the present invention. For example, the width $W_2$ of the second portion 1006 could be substantially greater or substantially less than the widths $W_1$ and $W_2$ of both of the first and third portions 1004 and 1008. Also, as is shown in FIG. 26, the width of the pad could be constantly changed while the feed assembly 54 is operating to produce a gradually tapering pad without the discrete sections shown in FIG. 25.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the following claims.

What is claimed is:

1. A cushioning conversion machine for converting sheet stock material into a three-dimensional cushioning product, said machine comprising:

a forming assembly which forms the stock material into a strip;

a feed assembly which advances the stock material through the forming assembly; and a device that has a pair of guide members between the forming assembly and the feed assembly that are adjustably movable relative to one another to selectively vary the width of the strip.

2. A cushioning conversion machine as set forth in claim 1 wherein the device includes a mounting assembly mounting the guide members relative to the machine's frame.

3. A cushioning conversion machine as set forth in claim 2 wherein:

the forming assembly includes a chute;

the feed assembly includes a pair of rotating feed members; and the mounting assembly positions the guide members between an exit end of the chute and the rotating feed members and allows selective adjustment of the spacing between the guide members.

4. A cushioning conversion machine as set forth in claim 3 wherein the mounting assembly allows selective adjustment of the guide member spacing between a distance which is the same or greater than the width of the exit end of the chute and a distance which is less than the width of the exit end of the chute.

5. A cushioning conversion machine as set forth in claim 4 wherein the mounting assembly allows selective adjustment of the guide member spacing to a plurality of distances which are less than the width of the exit end of the chute.

6. A cushioning conversion machine as set forth in claim 2 wherein the guide members are rollers which are rotatably mounted on the mounting assembly whereby they are freely turnable as the strip passes therethrough.

7. A cushioning conversion machine as set forth in claim 6 wherein the rollers have a concave shape along an axial dimension.

8. A cushioning conversion machine as set forth in claim 6 wherein the rollers have a spool shape with an axial dimension approximately equal to the height of the exit end of the chute and positioned to surround the lateral edges of the strip as it emerges from the chute.

9. A cushioning conversion machine as set forth in claim 2 wherein the mounting assembly includes an adjustment bar for setting the spacing between the guide members.

10. A cushioning conversion machine as set forth in claim 9 wherein the adjustment bar includes a locking member for locking the spacing between the guide members at certain predetermined intervals.

11. A cushioning conversion machine as set forth in claim 10 wherein said predetermined intervals corresponds approximately to 1" (about 2.5 cm) pad width increments.

12. A cushioning conversion machine as set forth in claim 1 wherein the are simultaneously movable equal distances.

13. A cushioning conversion machine as set forth in claim 1 wherein the device includes a member which is moved in a direction perpendicular to the upstream-downstream direction to vary the cross-sectional geometry of the cushioning pad.

14. A cushioning conversion machine as set forth in claim 1 wherein the device includes a member which is moved in a direction perpendicular to the upstream-downstream to vary the width of the cushioning pad.

15. A cushioning conversion machine as set forth in claim 2 wherein the mounting assembly includes a pair of arms each having one end pivotally mounted relative to the machine's frame and an opposite end rotatably supporting the guide members.

16. A cushioning conversion machine as set forth in claim 2 wherein the spacing between the guide members is set by moving an adjustment bar in a direction perpendicular to the upstream-downstream direction.

17. A cushioning conversion machine as set forth in claim 1 wherein the guide members are a pair of rollers.

18. A cushioning conversion machine as set forth in claim 16 wherein the device includes a control member which is situated outside the machine's housing for adjusting the spacing between the guide members.

19. A cushioning conversion machine as set forth in claim 18 wherein the control member is operably connected to the adjustment bar.

20. A cushioning conversion machine as set forth in claim 18 wherein the spacing includes a plurality of distances that correspond to predetermined intervals corresponding to about 1" (about 2.5 cm) pad width increments and wherein the external surface of the housing includes indicia indicating the various pad widths corresponding to the increments.

21. A cushioning conversion machine as set forth in claim 2 wherein the guide members have an axial dimension approximately equal to the height of the exit end of the chute.

22. A cushioning conversion machine as set forth in claim 2 wherein the device includes a locking member for locking the guide members in position relative to the mounting assembly.

23. A cushioning conversion machine as set forth in claim 1 wherein said device includes at least one adjustment member which is moved among a plurality of positions to change the width of the strip and wherein the device includes a motorized drive which moves the adjustment member among the plurality of positions.

24. A cushioning conversion machine as set forth in claim 23 wherein the motorized drive comprises a rotary motor which rotates the adjustment member.

25. A cushioning conversion machine as set forth in claim 24 wherein the rotary motor is a reversible motor.

26. A cushioning conversion machine as set forth in claim 1 wherein the device includes a member which is moved in a direction parallel to the upstream-downstream direction to vary the width of the cushioning pad.

27. A cushioning conversion machine as set forth in claim 2 wherein said selective adjustment may be done without changing the positioning of the mounting assembly relative to the machine's frame.

28. A cushioning conversion machine as set forth in claim 2 wherein the guide members are selectively positionable on the mounting assembly.

29. A cushioning conversion machine as set forth in claim 27 wherein the guide members are non-rotatably supported by the mounting assembly.

30. A cushioning conversion machine as set forth in claim 2 wherein the guide members each have a cylindrical shape.

31. A cushioning conversion machine as set forth in claim 30 wherein the mounting assembly includes a pair of posts fixedly mounted relative to the machine's frame and to which the guide members are mounted.

32. A cushioning conversion machine as set forth in claim 31 wherein the guide members include an axial core through which the posts of the mounting assembly extend, the core being eccentrically located with reference to a central axis of the guide member whereby the distance between the outer circumferences of the guide members may be changed by changing the positioning of the guide members on the posts.

33. A cushioning conversion machine as set forth in claim 23 further comprising a control system for controlling the motorized drive to move the adjustment member among the plurality of positions.

34. A cushioning conversion machine as set forth in claim 33 wherein the control system includes an input device for inputting the desired width of the pad.

35. A cushioning conversion machine as set forth in claim 33 wherein the control system includes a feedback device for determining the position of the adjustment member among the plurality of positions.

36. A cushioning conversion machine as set forth in claim 33 wherein the control system includes a display for displaying the position of the adjustment member among the plurality of positions.

37. A cushioning conversion machine as set forth in claim 33 wherein the control system also includes the feed assembly.

38. A cushioning conversion machine as set forth in claim 33 wherein the control system includes an internal controller.

39. A cushioning conversion machine as set forth in claim 33 wherein the control system includes an external controller.

40. A cushioning conversion machine as set forth in claim 33 wherein the control system includes an operator interface/monitor.

41. A method of converting sheet stock material into a three-dimensional cushioning product, said method comprising the steps of:

supplying a sheet stock material;

providing a cushioning conversion machine having a forming assembly which forms the stock material into a strip, a feed assembly which advances the stock material through the forming assembly, and a device having a pair of guide members between the forming assembly and the feed assembly that are adjustable to change the width of the strip;

converting the stock material into a strip of a certain width;

adjusting the device to adjust the width of the strip;

converting the stock material into a strip of different width; and wherein said adjusting step is performed between said converting steps.

42. A method as set forth in claim 41 wherein said adjusting step is accomplished by moving an adjustment bar in a direction perpendicular to the upstream-downstream direction.

43. A method as set forth in claim 41 wherein said adjusting step is accomplished with a motorized drive.

44. A method as set forth in claim 41 wherein said adjusting step is performed without stopping said converting steps.

45. A method as set forth in claim 41 wherein said adjusting step is accomplished by moving an adjustment bar in a direction parallel to the upstream-downstream direction.

46. A method as set forth in claim 41 wherein said adjusting step is accomplished by moving a control element situated outside of the housing.

47. A method as set forth in claim 41 wherein said adjusting step comprises the steps of inputting a desired width of a cushioning pad into a controller and then adjusting the device which controls the width of the strip in accordance with this input.

48. A method as set forth in claim 41 wherein said adjusting step is performed between said converting steps.

49. A cushioning conversion machine for converting a sheet stock material into a cushioning pad, the machine including a device for selectively varying the cross-sectional geometry of the cushioning pad produced by the machine, the device including a pair of members disposed on opposing sides of a path of the stock material that are movable towards and away from each other to selectively vary the cross-sectional geometry of the cushioning pad.

50. A cushioning conversion machine as set forth in the claim 49 wherein the device varies the width of the cushioning pad produced by the machine.

51. A cushioning conversion machine as set forth in claim 49 wherein the device includes a motorized drive.

52. A cushioning conversion machine as set forth in claim 49, wherein the device comprises a pair of members which are movable towards and away from each other to selectively vary the cross-sectional geometry of the cushioning pad.

53. A cushioning conversion machine as set forth in claim 49 wherein the pair of members are positioned on opposite transverse sides of the cushioning pad.

54. A cushioning conversion machine as set forth in claim 49 wherein the machine includes a housing and wherein the device includes a control element situated outside of the housing whereby the housing need not be opened to vary the cross-sectional geometry of the cushioning pad.

55. A cushioning conversion machine as set forth in claim 50 wherein the device includes a guide member fixedly mounted on a movable mounting assembly.

56. A cushioning conversion machine as set forth in claim 50 wherein the device includes a guide member movably mounted on a movable mounting assembly.

57. A cushioning conversion machine as set forth in claim 50 further comprising a control system for controlling the device to selectively vary the cross-sectional geometry of the cushioning pad produced by the machine.

58. A cushioning conversion machine including a device having a pair of guide members that guide a stock material as the stock material travels between a forming assembly and a feed assembly, the guide members selectively movable to adjust the spacing therebetween to vary the width of a strip of cushioning produced by the machine.

* * * * *